US006965743B2

(12) United States Patent
Nakagawa et al.

(10) Patent No.: US 6,965,743 B2
(45) Date of Patent: Nov. 15, 2005

(54) DEVELOPING APPARATUS

(75) Inventors: Ken Nakagawa, Mishima (JP); Junichi Ochi, Shizuoka-ken (JP); Takeshi Kawamura, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 17 days.

(21) Appl. No.: 10/770,478

(22) Filed: Feb. 4, 2004

(65) Prior Publication Data

US 2004/0190922 A1 Sep. 30, 2004

(30) Foreign Application Priority Data

Feb. 4, 2003 (JP) ..... 2003/027638

(51) Int. Cl.[7] ..... G03G 15/06
(52) U.S. Cl. ..... 399/55; 399/286
(58) Field of Search ..... 399/55, 150, 149, 399/270, 271, 272, 274, 281, 284, 285, 286, 279

(56) References Cited

U.S. PATENT DOCUMENTS

| | | | | |
|---|---|---|---|---|
| 5,247,333 | A | 9/1993 | Yamamoto et al. | |
| 5,640,651 | A | 6/1997 | Katoh et al. | 399/119 |
| 6,314,257 | B1 | 11/2001 | Ishii et al. | 399/150 |
| 6,522,842 | B1 * | 2/2003 | Uehara et al. | 399/55 |
| 6,647,225 | B2 * | 11/2003 | Kakeshita | 399/100 |
| 2002/0009305 | A1 | 1/2002 | Uehara | 399/55 |

FOREIGN PATENT DOCUMENTS

| | | |
|---|---|---|
| JP | 56-123573 | 9/1981 |
| JP | 56-123574 | 9/1981 |
| JP | 2-101485 | 4/1990 |
| JP | 6-27807 | 2/1994 |
| JP | 6-51623 | 2/1994 |
| JP | 6-16210 | 3/1994 |
| JP | 8-179608 | 7/1996 |

OTHER PUBLICATIONS

Patent Abstracts of Japan, Publication No. 56–123573, Sep. 28, 1981.

* cited by examiner

*Primary Examiner*—Hoang Ngo
(74) *Attorney, Agent, or Firm*—Fitzpatrick, Cella, Harper & Scinto

(57) ABSTRACT

A developer apparatus includes a developer carrying member, for carrying a developer to a developing portion, the developer carrying member including an electroconductive base and a resistance layer provided thereon; a developer feeding member for being supplied with a voltage to supply the developer to the developer carrying member; wherein a surface moving speed of the developer carrying member Vp [mm/sec], a resistance R1 (Ω) of the developer carrying member when an electric current applied the developer carrying member is 0.04 Vp [μA], and a resistance R2 (Ω) or the developer carrying member when the electric current applied to the developer carrying member is 4 Vp [μA], satisfy:

$r1/R2<15.$

18 Claims, 11 Drawing Sheets

(a)

(b)

DEVELOPING APPARATUS

FIELD OF THE INVENTION AND RELATED ART

The present invention relates to a developing apparatus employed by an electrophotographic or electrostatic image forming apparatus, a process cartridge removably mountable in the main assembly of an image forming apparatus, and the like. Here, an electrophotographic image forming apparatus means a printer, a facsimile machine, a copying machine, etc.

A developing apparatus which uses a nonmagnetic single-component developer to develop an electrostatic latent image into a visible image has been realized. FIG. 14 is a schematic sectional view of a typical developing apparatus in accordance with the prior art which uses a nonmagnetic single-component developer.

Referring to FIG. 14, a developing apparatus 4 has a developer container (toner container) 8 which holds toner 7, for example, dielectric nonmagnetic single-component developer, the inherent electrical polarity of which is negative. The toner 7 contains a yellow, magenta, cyan, or black coloring matter, or the like, in the form of pigment or dye. The developer container 8 has a hole which faces an image bearing member 1 which bears a latent image to be developed. Through this hole, a development roller 5, as a developer carrier, rotatably supported by the walls of the developer container 8, is partially exposed.

Within the developer container 8, a developer stirring member (toner stirring member) 15 is disposed, which is in one of various forms, for example, a flat plate, a screw, etc., and is rotated in the direction indicated by an arrow mark in the drawing to convey the toner 7 in the developer container 8 toward the development roller 5. The number and shape of the toner stirring member 15 is chosen in consideration of the shape of the developer container 8 so that the toner 7 can be efficiently conveyed to the adjacencies of the development roller 5 even from the corners of the developer container 8.

In a magnetic development method, the development roller 5 is provided with magnetism in order to attract the magnetic single-component developer (toner), which contains magnetic substance, to the development roller 5. However, in the case of a nonmagnetic single-component development method, the magnetism of the toner is extremely weak, making it difficult to attract the toner by magnetic force. Thus, in many cases, it is necessary to provide the developing apparatus 4 with a means for placing toner on the peripheral surface or the development roller 5. There are other means for placing toner on the peripheral surface of the development roller 5, which will be described later. Generally, the developing apparatus 4 is provided with a toner stripping-supplying roller 13 as a developer supplying member, which is disposed in the adjacencies of the development roller 5 so that the peripheral surfaces of the two rollers 3 and 5 remain in contact with, or virtually in contact with, each other.

The toner stripping-supplying roller 13 is rotationally driven at a predetermined peripheral velocity, which is generally different from the peripheral velocity at which the development roller 5 is rotationally driven. The rotational direction of the toner stripping-supplying roller 13 in the contact area, or virtual contact area, between the two rollers 3 and 5 may be the same as that of the development roller 5, or opposite thereto, as long as there is a proper amount of difference in peripheral velocity between the two rollers 3 and 5, not only for supplying a given area of the peripheral surface of the development roller 5 with a proper amount of toner, but also for stripping away the toner particles remaining on a given area of the peripheral surface of the development roller 5, that is, the toner particles which were not used for development, after the given area passes the development station, that is, the point at which the given area faces a target 1 to be developed.

Also disposed within the developer container 8 is a partitioning plate 16 for partitioning the internal space of the developer container 8. The partitioning plate 16 is optimized in height so that the amount by which the toner 7 remains in the adjacencies of the development roller 5 and toner stripping-supplying roller 13 after being conveyed to the development roller 5 will be virtually constant.

The developing apparatus 4 is also provided with a regulating blade 6, as a member for regulating the amount of the developer on the peripheral surface of the development roller 5. The regulating blade 6 is placed in contact with the development roller 5. It forms a thin layer of the toner 7 by regulating the amount by which the toner 7 is allowed to remain on the peripheral surface of the development roller 5. In other words, it plays the role of regulating the amount by which the toner 7 is conveyed to the development station (area in which peripheral surface of development roller 5 is placed in contact, or virtually in contact, with development target). It also plays the role of rubbing the toner 7 so that the toner 7 is charged by the friction between the toner 7 and regulation blade 6. Generally, the regulation blade 6 comprises: a piece of thin metallic plate formed of phosphor bronze, stainless steel, or the like, with a thickness of several hundreds of micrometers, and a piece of urethane rubber or the like welded to the edge of the metallic plate. It is placed in contact with the development roller 5 so that the elasticity of the thin metallic plate makes the contact pressure between the regulating blade 6 and the peripheral surface of the development roller 5 uniform across the entire range of the contact area.

The amount by which the toner 7 is conveyed to the development station, in which the distance between the development target 1 and peripheral surface of the development roller 5 is smallest, and the amount of electrical charge the toner 7 will be given, are dependent upon the contact pressure between the development roller 5 and the regulating blade 6 pressed thereon, and size of the contact area between the development roller 5 and regulating blade 6. The contact pressure is dependent upon several factors, more specifically, the material and thickness of the metallic thin plate, the amount by which the regulating blade 6 is bend, and the contact angle between the development roller 5 and regulating blade 6. Generally, these factors are set so that the amount by which the toner 7 is carried on the peripheral surface of the development roller 5, per unit area, falls in the range of 0.3–1.0 mg/cm$^2$.

Referring to FIG. 14, the development target 1, the peripheral surface of the electrophotographic photosensitive member 1 (photosensitive drum) as an image bearing member, normally in the form of a drum, is moved in the direction indicated by an arrow mark, to the development station, in which the distance between the development target 1 and the peripheral surface of the development roller 5 is smallest. In the development station, the toner 7 on the development roller 5 adheres to the electrostatic latent image on the development target 1, developing the electrostatic latent image into an image formed of toner, that is, a visible image.

As a means for supplying the development roller 5 vital toner, in addition to the above described stripping-supplying roller 13 disclosed in Japanese Patent Application Publication 6-16210, there are a few conventional toner supplying means based on the prior arts. For example, Japanese Laid-open Patent Application 2-101485 discloses a toner supplying means in the form of a rotatable member, the peripheral surface is rough, and which is not placed in contact with the development roller, and Japanese Laid-open Patent Application 8-179608 discloses a toner supplying means in the form of a polygonal shaft, which is not placed in contact with the development roller 5.

Also as the toner supplying means based on the prior art, there is a toner supplying means in the form of a piece of wire disposed in a developing apparatus, which is disclosed in Japanese Laid-open Patent Applications 56-123573, 56-123574, and 6-51623. Japanese Laid-open Patent Applications 56-123573, 56-123574 are related to a development method employing a magnetic brush, and disclose a toner supplying means which employs a piece of wire to magnetically or mechanically stir a magnetic brush. Japanese Laid-open Patent Application 6-51623 discloses a toner supplying means in the form of a piece of wire which is used for stripping, by the mechanical contact pressure or electrically induced vibrations, the toner on a development roller, to which AC voltage is being applied. These patent document, however, do not mention any of the following discoveries which were made by the inventors of the present invention, through the intensive studies carried out by the inventors, and which will be described later; for example, the effect of the electrical discharge induced through the body of toner packed between the piece of wire and development roller, upon the efficiency with which the development roller is supplied with the toner, the effects of the toner flow and toner supplying flow created in the adjacencies of the piece of wire, upon the efficiency with which the development roller is supplied with toner, the problem which the piece of wire creates when the voltage applied between the development roller and wire is substantially greater than the discharge threshold voltage, in other words, when the amount of current is greater.

A development method, such as the one disclosed in the aforementioned Japanese Laid-open Patent Application 6-16210, which employs a stripping-supplying roller 13 as a developer supplying member, was problematic in that there is a difference in peripheral velocity between the development roller 5 and stripping-supplying roller 13, which causes the peripheral surfaces of the two rollers to rub against each other, increasing thereby the amount of the torque necessary to drive the developing apparatus 4.

In the case of the methods, disclosed in the aforementioned Japanese Laid-open Patent Applications 2-101485 and 8-179608, for supplying the development roller 5 with toner, the developer supplying member is not in contact with the development roller 5. Therefore, these methods seem to be smaller in the amount of torque necessary to drive the developing apparatus 4. However, they still require the force necessary to rotationally drive the developer supplying member, being therefore as complicated as the method disclosed in Japanese Laid-open Patent Application 6-16210, from the standpoint of the mechanism for driving the various moving members. Also in the case of the methods disclosed in Japanese Laid-open Patent Applications 2-101485 and 8-179608, the developer supplying member which has a certain amount of volume is positioned in the adjacencies of the development roller 5, with no contact between the two, adversely affecting the effort to reduce the developing apparatus 4 in size.

Further, as voltage was applied to the developer supplying member in order to supply the development roller 5 with developer, the electric current which flowed from the developer supplying member to the development roller sometimes became nonuniform due to local current leaks, reducing thereby the level of uniformity at which developer was supplied to the development roller. This nonuniformity in the amount by which developer was supplied sometimes resulted in the formation of a streaky image.

Also as voltage was applied to the developer supplying member to supply the development roller 5 with developer, the electrical current which flowed from the developer supplying member to the development roller sometimes affected the development potential, enough to cause the image forming apparatus to yield a defective image such as a foggy image.

SUMMARY OF THE INVENTION

The primary object of the present invention is to provide a developing apparatus which does not suffer from the problem that the level of uniformity and consistency at which developer is supplied to the developer carrying member is reduced by the local current leaks from the developer supplying member to the developer carrying member.

Another object of the present invention is to provide a developing apparatus which does not contribute to the formation of a defective image such as a streaky image.

Another object of the present invention is to provide a developing apparatus which does not suffer from the problem that the development potential is affected by the electrical current which flows from the developer supplying member to the developer carrying member.

Another object of the present invention is to provide a developing apparatus which does not contribute to the formation of a defective image such as a foggy image.

Another object of the present invention is to provide a developing apparatus which is stable in the amount by which the developer carrying member is supplied with developer.

Another object or the present invention is to provide a developing apparatus which is capable of uniformly charging the developer on the developer carrying member, in proportion to the sate of discharge from the developer carrying member.

Another object of the present invention is to provide a developing apparatus which is smaller in the amount of the torque necessary to drive it, is simple in structure, and is smaller in size.

These and other objects, features, and advantages of the present invention will become sore apparent upon consideration of the following description of the preferred embodiments of the present invention, taken in conjunction with the accompanying drawings.

DETAILED DESCRIPTION OF THE PREFERRED EMBODIMENT

Hereinafter, the preferred embodiments of the present invention will be described in detail with reference to the appended drawings.

Embodiment 1

Figure 1:
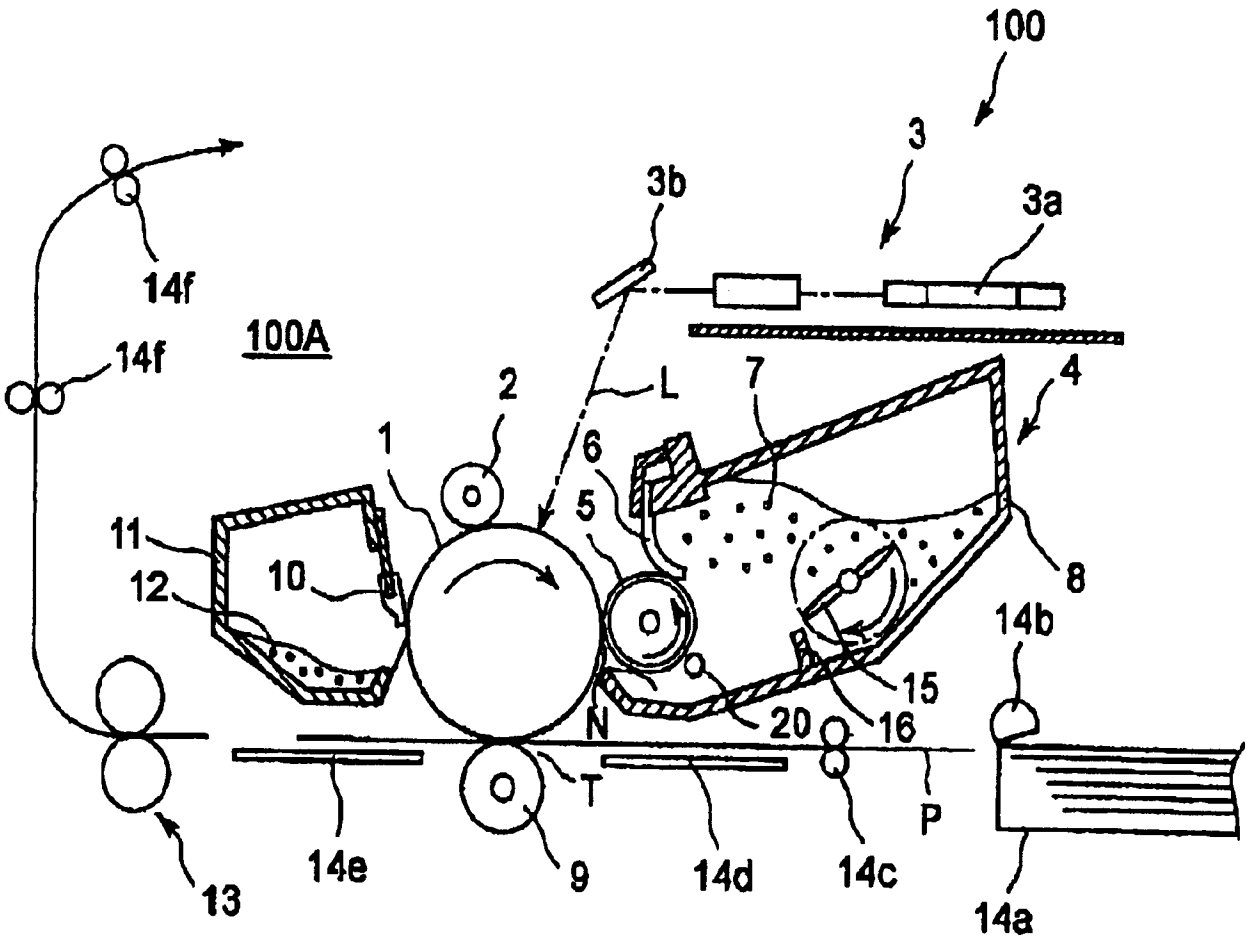
FIG. 1 is a schematic sectional view of the image forming apparatus in the first embodiment of the present invention.
Figure 2:
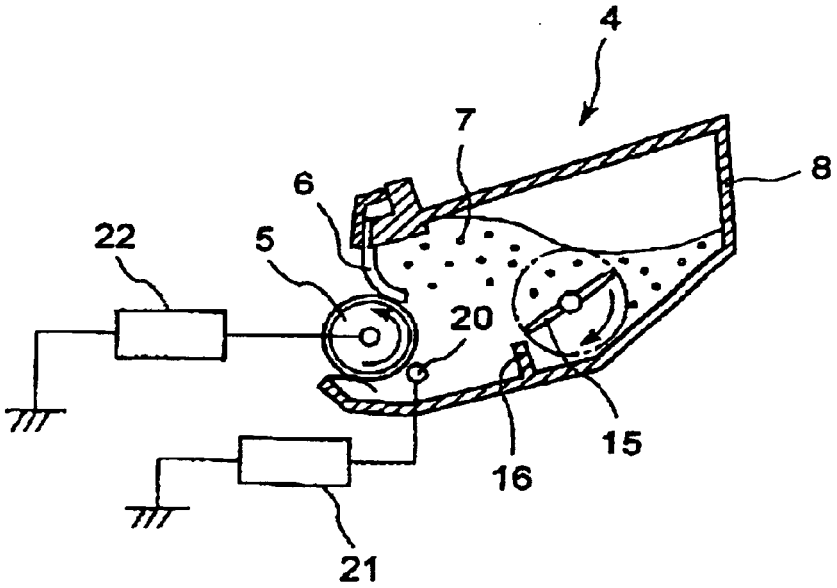
FIG. 2 is a schematic sectional view of the developing apparatus in the first embodiment of the present invention.

FIG. 1 is a schematic sectional view of the image forming apparatus in the first embodiment of the present invention. The image forming apparatus 100 in this embodiment is a laser beam printer, which forms an image on recording medium such as a recording paper or OHP sheet, with the use of one of the electrophotographic recording methods, in accordance with the image forming data from an external host, such as a personal computer, an original reading apparatus, etc., connected to the main assembly 100A of the image forming apparatus 100 in a manner to allow information to be exchanged between the two apparatuses.

First, referring to FIG. 1, the image forming apparatus will be described regarding general structure and operation. The image forming apparatus 100 is provided with an electrophotographic photosensitive member, as an image bearing member 1, which is in the form of a drum (which hereinafter will be referred to as "photosensitive drum 1"). It is also provided with a charge roller 2 as a charging means, an exposure optical system 3 as an exposing means, a developing apparatus 4 as a developing means, a transfer roller 9 as a transferring means, a cleaning blade 10 as a cleaning means, a waste toner container 11, etc., which are disposed in a manner to surround the peripheral surface of the photosensitive drum 1. The exposure optical system 3 comprises: a laser based exposing apparatus 3*a*, a reflection mirror 3*b*, etc.

The photosensitive drum 1 is rotated in the direction indicated by an arrow mark in the drawing, and is uniformly charged to −600 V by the charge roller 2 which is supplied with the electrical power from a high voltage power source (unshown) The charged peripheral surface of the photosensitive drum 1 is exposed to a beam of laser light L projected from the laser based exposing apparatus 3*b* and reflected by the rejection mirror 3*b*. As the charged peripheral surface of the photosensitive drum 1 is exposed to the beam of laser light L, the numerous points on the peripheral surface of the photosensitive drum 1 are reduced in electrical potential to −100 V. As a result, an electrostatic latent image is formed on the photosensitive drum 1. Then, this electrostatic latent image is developed by the developing apparatus 4. More specifically, in the development station N, the development roller 5 as a developer carrying member of the developing apparatus 4 is in contact with the photosensitive drum 1. As a voltage of −400 V is applied to the development roller 5, the toner on the development roller 5 is adhered to the electrostatic latent image on the photosensitive drum 1 by the potential difference created between the development roller 5 and photosensitive drum 1, developing thereby the latent image into an image formed of toner, that is, a visible image. This process of developing the latent image will be described later in more detail. The peripheral velocity of the development roller 5 is set to be faster than that of the peripheral velocity of the photosensitive drum 1; it is set to a value equal to roughly 110–170% the peripheral velocity of the photosensitive drum 1. In other words, the development roller 5 is rotated at a predetermined peripheral velocity to provide a certain amount or difference in peripheral velocity between the development roller 5 and photosensitive drum 1.

Meanwhile, recording mediums P (recording medium on which image is formed), such as recording papers are moved one by one out of a cassette 14*a* as a recording medium storage portion by a recording medium feeding roller 14*b*. Then, the recording mediums P are conveyed, in synchronism with the formation of the toner image on the photosensitive drum 1, through the recording medium conveying portion 14*d*, by a pair of registration rollers 14*c*, to the transfer station T (transferring portion), in which the transfer roller 9 is kept pressed against the peripheral surface of the photosensitive drum 1. In the transfer station T, the toner image on the photosensitive drum 1 is electrostatically transferred onto the recording medium P by the transfer roller 9 being supplied with electrical power by a high voltage power source (unshown).

After the transfer of the toner image onto the recording medium P, the recording medium P is separated from the photosensitive drum 1, and is conveyed to a fixing apparatus 13 through the recording medium conveying portion 14*e*. In the fixing apparatus 13, the toner image (unfixed) on the recording medium P is fixed to the recording medium P by heat and pressure. After the fixation of the toner image to the recording medium P, the recording medium, P is discharged out of the apparatus main assembly 100A by a plurality of pairs of recording medium discharging rollers 14*f*.

The transfer residual toner particles, that is, the toner particles remaining on the peripheral surface of the photosensitive drum 1 without being transferred onto the recording medium P are stored as waste toner 12 in the waste toner container 11 by the cleaning blade 10; in other words, the peripheral surface of the photosensitive drum 1 is cleaned. After the cleaning, the cleaned portion of the peripheral surface of the photosensitive drum 1 is used for the image forming process to be carried out during the following rotation of the photosensitive drum 1.

Next, the developing apparatus 4 in this embodiment will be described in more detail, with reference to FIG. 9, which is a schematic sectional view of the developing apparatus in this embodiment. The developing apparatus 4 is provided with the developer container 8 which holds the toner 7, which is dielectric, nonmagnetic, and single-component developer. The developer container 8 is provided with an elongated hole, which faces the photosensitive drum 1 and extends in the lengthwise direction of the photosensitive drum 1. The development roller 5 as a developer carrying member is disposed so that it is partially exposed from the developer container 8 through the elongated hole. There is provided a toner supplying member (toner supplying electrode) 20 for supplying the development roller 5, as a developer supplying member, with the toner 7. The toner supplying member 20 is extended in the lengthwise direction of the development roller 5, in parallel to the axial line or the development roller 5.

Within the developer container 8, the toner stirring member 15 is provided, which is a piece of plate rotatable in the direction indicated by an arrow mark in the drawing. The toner stirring member 15 also functions as the means for conveying the toner 7 in the developer container 8, toward the development roller 5.

Also disposed within the developer container 8 is the developer container partitioning member 16 which is optimized in height so that the amount of the toner 7 which remains in the adjacencies of the development roller 5 and toner supplying member 20 after being supplied thereto by the toner stirring member 15 will remain roughly constant.

The development roller 5 is rotationally driven by the driving weans of the apparatus main assembly100A (unshown) in the direction indicated by an arrow mark in the drawing at a peripheral velocity of 100 mm/sec. As the development roller 5 is rotated, the toner 7 carried on the peripheral surface of the development roller 5 is offered to the photosensitive drum 1, as the object to be developed, which is outside the developing apparatus 4.

The development roller 5 is connected to a developer bias power source 22 as a voltage applying means. The bias voltage applied to the development roller 5 is adjusted so that the toner 7 on the development roller 5 is stripped away from the development roller 5 and moved to the photosensitive drum 1 by the electric field created between the photosensitive drum 1 and development roller 5 by the bias voltage. In this embodiment, the development bias is an DC voltage of −400 V.

In order to form a thin layer of the toner 7 uniform in thickness, the regulating blade 6 is disposed in contact with the peripheral surface of the development roller 5. The regulating blade 6 is a member for regulating the amount by which developer is mounted on the peripheral surface of the development roller 5. It is a piece of thin stainless steel plate with a thickness of 200 $\mu$m. It is disposed in contact with the peripheral surface of the development roller 5 so that the contact pressure between the development roller 5 and regulating member 6 remains relatively uniform across the entire range of the contact area.

At this time, the role the toner supplying member 20 plays in supplying the development roller 5 with the toner 7 will be described.

In this embodiment, the amount by which the toner 7 is conveyed to the development station N, in which the peripheral surfaces of the photosensitive drum 1 and development roller 5 are virtually in contact with each other, that is, the amount by which the toner 7 is carried by the peripheral surface of the development roller 5, per unit area, is set to roughly 0.6 mg/cm$^2$. The toner 7 is desired to be a nonmagnetic single-component developer with an average particle diameter of 5–15 $\mu$m. In this embodiment, a nonmagnetic single-component developer which is inherently negatively chargeable and is 7 $\mu$m in average particle diameter is used. The amount of the electrical charge carried by the toner 7 in this embodiment is roughly −30 $\mu$C/g.

The average particle diameter of the toner 7 was measured in the following manner. First, a Coulter counter TA-II, a Coulter multisizer (Coulter Co., Ltd.), or the like was connected to an interface (Nikkaki Co., Ltd.) for outputting the number distribution and volume distribution, and a personal computer PC9801(NEC). Then, 1% water solution of sodium chloride was prepared as an electrolyte using first class sodium chloride. Then, 0.1–5 ml of surfactant (preferably, one of alkylbenzene sulfonates), as a dispersant, was added to 100–150 ml of the above described water solution of sodium chloride as an electrolyte, and then, 2–20 mg of test sample was added to the mixture. Then, the electrolyte in which the test sample was suspended was subjected to an ultrasonic dispersing device for roughly 1–3 minutes. Then, the number of the toner particles, the volume of which was no less than 2 $\mu$m, was counted with the use of the Coulter counter TA-II, for example, fitted with a 100 $\mu$m aperture. Then, the volume distribution of the toner 7 was obtained. Then, the weight average particle diameter of the toner 7 was obtained as the average particle diameter of the toner 7.

The amount of the electrical charge of the toner 7 was obtained in the following manner. The toner 7 on the peripheral surface of the development roller 5 was collected; it was sucked up by a collecting tool. The collecting tool was fitted with a membrane filter. The toner 7 was suctioned with a force of 200 mm$H_2O$, and was collected on the filter. The collecting tool was connected to an electrometer (Mode 617, KEITHKEY Co., Ltd.), which measured the total amount of the electrical charge of the collected toner. More specifically, the amount of the collected toner was obtained by calculating the increase in the weight of the filter, and the total amount of the electrical charge was divided by the weight of the collected toner to obtain the average amount of electrical charge per unit weight of toner, as the amount of toner charge.

One of the preferable materials for the toner supplying member 20 is a piece of electrically conductive wire. In this embodiment, a piece of tungsten wire which is virtually circular in cross section and is 0.1 mm in diameter is employed as the toner supplying member 20. The toner supplying member 20 is stretched virtually in parallel to the axial direction of the development roller 5 across the entirety of the toner carrying range of the development roller 5.

The toner supplying member 20 is disposed so that when there is absolutely no toner 7 in the developer container 8, and the development roller 5 is not being driven, the toner supplying member 20 will be in contact with the development roller 5, or no more than 0.5 mm away from the development roller 5. When the developing apparatus 4 is normally operating, the adjacencies or the toner supplying member 20 remain filled with the toner 7.

Even when the toner supplying member 20 is disposed so that it will be in contact with the development roller 5 when there is no toner 7 in the developer container 8 and the development roller 5 is not being driven, it is disposed so that the contact pressure between the two components will be small enough for the toner supplying member 20 to be kept away, by a distance equal to several times the average particle diameter of the toner, by the toner flow which will be created by the toner 7 adhering to the peripheral surface of the development roller 5, as the development roller 5 is rotationally driven.

The toner supplying member 20 is connected to a toner supplying bias power source 21 as a voltage applying means. The toner supplying bias is applied to the toner supplying member 20 from the toner supplying bias power source 21, so that at least during a developing process, the potential difference between the toner supplying member 20 and development roller 5 will remain no less than the threshold voltage for electrical discharge. The toner supplying bias power source 21 applies to the toner supplying member 20 such voltage that causes electrical current, which is the same in polarity as that of the toner 7, to flow from the toner supplying member 20 to the development roller 5. In this embodiment, such toner that is negative inherent polarity is used as the toner 7. Therefore, the voltage applied to the toner supplying member 20 from the toner supplying bias power source 21 is such voltage that causes negative current to flow from the toner supplying member 20 to the development roller 5. In other words, the polarity of "toner supplying bias—development bias" is the same as that of the polarity of the toner charge.

Figure 3:
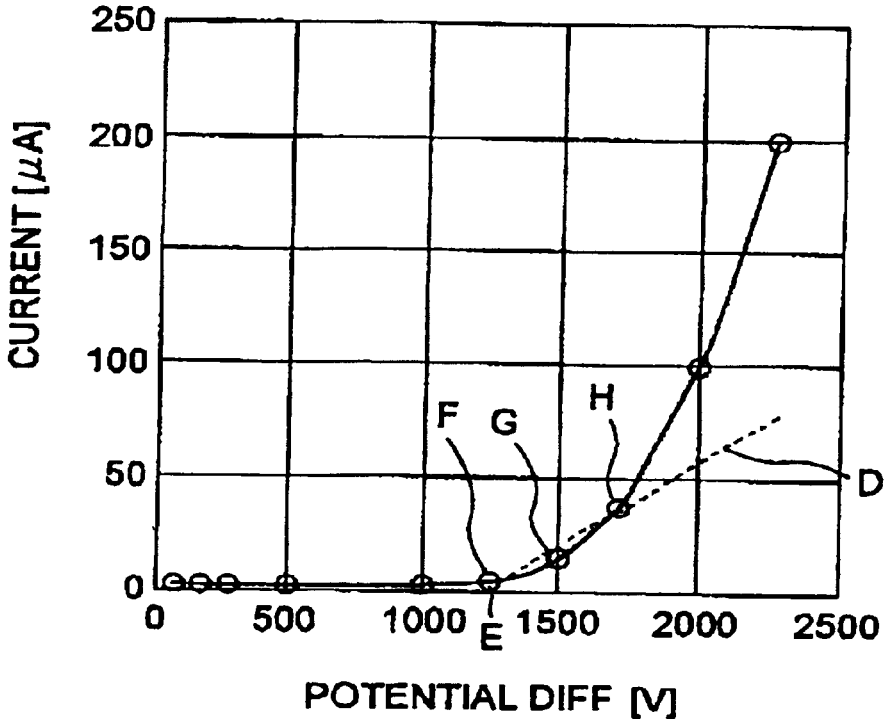
FIG. 3 is a graph which shows the relationship between the potential difference between the development roller and toner supplying member, and the amount of the electrical current which flows between the development roller and toner supplying member.
Figure 4:
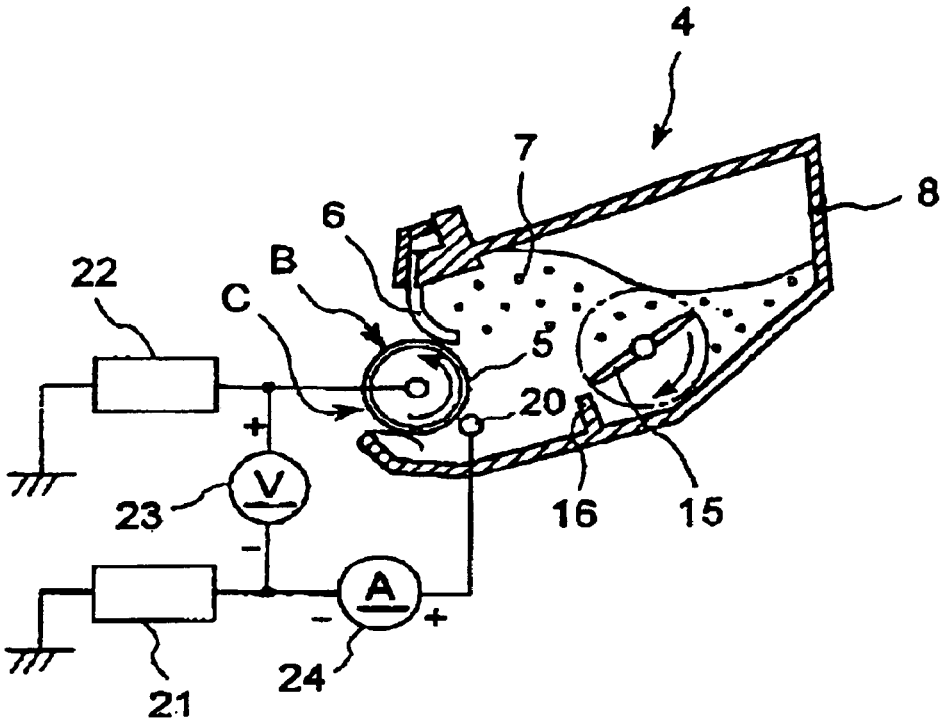
FIG. 4 is a drawing for describing the measurement system used for obtaining the results shown in FIG. 3.

To describe in more detail with reference to FIGS. 3 and 4. FIG. 3 shows the relationship between the values of the electrical current which flowed through the toner supplying member 20 as the development roller 5 of the developing apparatus 4 in this embodiment was rotated at the aforementioned peripheral velocity (100 mm/sec), and various levels at which voltage was applied to she toner supplying member 20. FIG. 4 shows the system used for measuring the amount of the electrical current. In the case of the system shown in FIG. 4, the positive side of the voltmeter 23 was connected to the development roller 5, and the negative side was connected to the toner supplying member 20, whereas the positive side of the ammeter 24 was connected to the toner supplying member 20 and the negative side was connected to the toner supplying bias power source 21. In other words, if the polarity of the current is positive in FIG. 3, it means that current flows from the development roller 5 to the toner supplying member 20. In this embodiment, however the toner with negative inherent polarity is used as the toner 7. Therefore, the current which flows from the toner supplying member 20 to the development roller 5 is the same in polarity as the charge of the toner 7, and therefore, negative current flows from the toner supplying member 20 to the development roller 5.

Referring to FIG. 3, as the difference between the potential levels of the development roller 5 and toner supplying member 20 measured by the voltmeter 23 is gradually increased, current begins to flow when the difference reaches a certain value (which hereinafter will be referred to as "discharge threshold voltage"). This value as the discharge threshold voltage is obtained in the following manner. That is, while rotating the development roller 5 at a peripheral velocity of Vp [mm/sec], the amount of the current which flows between the toner supplying member 20 and development roller 5 is measured in relation to the potential difference between the toner supplying member 20 and development roller 5. Then, several points on the axis representing the potential difference between the toner supplying member 20 and development roller 5 are selected from the range in which no less than 0.04 Vp [$\mu$A] flows, and the current values corresponding to the potential differences at the selected points are obtained. Then, a mathematical formula assumed to represent the linear relationship between the potential difference and the current value is obtained. Then, the value of the point (potential difference), at which the current value calculated from the mathematical formula becomes zero, is assumed to be the discharge threshold voltage. As for the discharge threshold voltage E in this embodiment, three points (F, G, and H) were selected from the range, on the axis of abscissas, in which no less than 4 $\mu$A flowed, and the mathematical formula was obtained for a straight line approximating the assumed linear relationship between the potential difference between the tones supplying member 20 and development roller 5, and the amount of the current between the toner supplying member 20 and development roller 5. Then, the discharge threshold voltage E was obtained from this mathematical formula; it was roughly 1,210 V. From the standpoint of the accuracy of the calculated discharge threshold voltage, the points to be selected for estimating the linear relationship are desired to be in the range in which the current value is relatively small, that is, in the range in which the current value is no less than 0.4 Vp [$\mu$m] and no more than 0.04 Vp [$\mu$m]×10.

That is, normally, the amount of the toner 7 carried on the peripheral surface of the development roller 5, per unit of area, in the developing apparatus (nonmagnetic single-component developing apparatus) which uses nonmagnetic single-component developer is desired to be roughly 0.6 mg/cm$^2$, and the amount of the toner charge of the toner 7 being carried on the peripheral surface of the development roller 5 is desired to be roughly −30 $\mu$C/g. The length of the development roller 5 of a developing apparatus capable of handling recording medium P of A4 size is roughly 230 mm, and that for a developing apparatus capable of handling recording medium P of A3 size is roughly 320 mm. Thus, the amount by which the electrical charge is moved (equivalent to electrical current), per unit of time, by of the toner on the peripheral surface of the development roller 5 is desired to be 0.0414 Vp [$\mu$C/s] and 0.0576 Vp [$\mu$C/s] for developing apparatuses capable of handling recording medium P of A4 size and A3 size, respectively.

It is possible that even when the potential difference between the toner supply member 20 and development roller is no more than the discharge threshold voltage, current will flow as dark current at these levels. Therefore, the discharge threshold voltage can be obtained by measuring the current value in the range in which the amount of the current is no less than these values. The studies made by the inventors of the present invention revealed the following. That is, the discharge threshold voltages for developing apparatuses enabled to handle recording medium the size of which falls in the range of A4 to A3 can be approximated by selecting the aforementioned points on the axis of abscissas, from the range in which no less than 0.04 V [$\mu$A] flows. The discharge threshold voltages for developing apparatuses enabled to handle recording medium of no less than A3 size can be obtained simply by compensating the discharge threshold voltages for the apparatuses for A4 to A3 sizes for the difference in size. Although the discharge threshold voltage is affected by the materials for toner, materials for the surface layers of the toner supplying member 20 and development roller 5, distance between the peripheral surfaces of the toner supplying member 20 and development roller 5, and the like factors, it generally falls in the range of 100–2,000 V.

In order to study in detail the consumption of the toner 7 on the development roller 5, and the role the toner supplying member 20 plays in supplying the peripheral surface of the development roller 5 with toner, the following experiments were carried out. That is, referring to FIG. 4, the development roller 5 was partially exposed from the developer container 8, on the downstream side of the contact area between the regulation blade 6 and development roller 5, in terms of the rotational direction of the development roller 5, and the toner 7 on the peripheral surface of the development roller 5 was suctioned up with the use of a vacuum cleaner, across virtually the entire range of the development roller 5 (in terms of axial direction), (at the point indicated by arrow mark B in FIG. 4), at various levels of the potential difference between the toner supplying member 20 and development roller 5, while measuring the current values with the use of the measuring system shown in FIG. 4, in order to study the condition of the toner layer on the peripheral surface of the development roller 5, on the upstream side of the point of the suction (point indicated by arrow mark B in FIG. 4).

In the experiment in which the current value was set to no more than roughly 0.04 Vp [$\mu$A] (4 $\mu$A in this embodiment), for example, 1 $\mu$A, and the toner 7 on the peripheral surface of the development roller 5 was suctioned in the manner described above, for a length of time equivalent to a single rotation of the development roller 5, the amount of the toner which was on the peripheral surface of the development roller 5 during the second rotation, and thereafter, was clearly smaller than that during the first rotation. In other words, the amount by which the toner 7 was coated on a given point on the peripheral surface of the development roller 5 while the given point was moved inward of the developer container 8, was not large enough to compensate for the amount by which the toner 7 was suctioned away by the vacuum, cleaner.

However, as the potential difference between the development roller 5 and toner supplying member 20 was gradually increased, the peripheral surface of the development roller 5 began to be seen partially coated with the toner 7; the amount by which the peripheral surface of the development roller 5 was coated with the toner 7 began to partially compensate for the amount by which the toner 7 on the development roller 5 was suctioned away by the vacuum cleaner, even during the second rotation of the development roller 5 and thereafter.

As the 0.08 Vp [$\mu$A] (8 $\mu$A in this embodiment) of current was flowed by increasing the potential difference to 1,350 V, the development roller 5 began to be coated with the toner 7 across the entirety of the peripheral surface of the development roller 5. As will be evident from the above description, in order to supply the entirety of the peripheral surface of the development roller 5 with the toner 7, it is desired to flow no less than 0.08 Vp [$\mu$A] of current between the development roller 5 and toner supplying member 20, in consideration of discharge rate, which will be described later.

Figure 5:
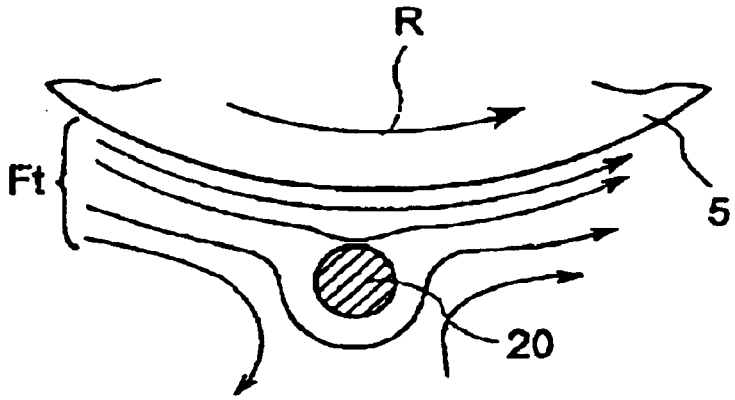
FIG. 5 is a schematic sectional view for depicting the role of the toner supplying member in the toner supplying process.

FIG. 5 schematically shows the flow of the toner 7 in the adjacencies of the toner supplying member 20 while toner supplying bias is not applied. When there is no toner 7 between the development roller 5 and toner supplying member 20, and the development roller 5 is not being rotated, the toner supplying member 20 is virtually in contact, or actually in contact, with the development roller 5. As the development roller 5 begins to be rotated in the direction indicated by an arrow mark R in the drawing, the toner 7 gradually begins to adhere to the peripheral surface of the development roller 5, creating thereby a toner current Ft which flows along the peripheral surface of the development roller 5. This toner current Ft generates such a force that acts in the direction to push the toner supplying member 20 away from the development roller 5, creating a gap between the development roller 5 and toner supplying member 20, through which the toner 7 flows.

In the case of a developing apparatus in which the toner supplying member 20 is formed of dielectric substance such as Nylon thread or the like, as the toner 7 on the peripheral surface of the development roller 5 is consumed, that is, as the toner 7 on the peripheral surface of the development roller 5 moves onto the photosensitive drum 1 as the object of development (equivalent to above described stripping by vacuum cleaner), while no potential difference is provided between the toner supplying member 20 and development roller 5, the toner 7 diminishes from the peripheral surface of the development roller 5, exposing thereby some areas of the peripheral surface of the development roller 5. As a result, the flow of the toner 7 suddenly weakens. Thereafter, it takes 2–5 rotations of the development roller 5 for the toner flow F5 to be strengthened by the adhesion of the toner 7 to the peripheral surface of the development roller 5, which gradually occurs due to the chance contact between the toner 7 and peripheral surface of the development roller 5. In other words, once the toner 7 on the peripheral surface of the development roller 5 is consumed, it takes several rotations of the development roller 5 for the toner layer to be reformed on the peripheral surface of the development roller 5, making it impossible for the development roller 5 to continuously supply the photosensitive drum 1 with the toner 7.

Figure 6:
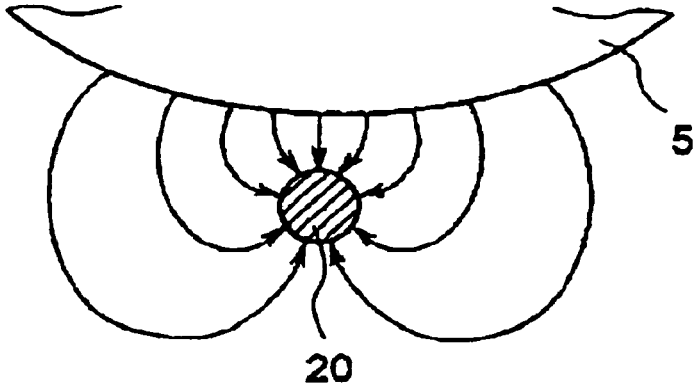
FIG. 6 is a schematic sectional view for depicting the role of the toner supplying member in the toner supplying process.

FIG. 6 shows the state of the electrical field generated when a certain amount of potential difference is provided between the toner supplying member 20 and development roller 5. As the potential difference is provided between the toner supplying member 20 and development roller 5, the charged toner 7 is subjected to the force of the electrical field generated by the potential difference. In this embodiment, the toner 7 is such toner that is negative in inherent polarity. Therefore, the toner 7 is subjected to such a force that acts in the direction to move the toner in the direction opposite to the direction of the arrow marks (arrows showing direction of electrical field) in FIG. 6. In other words, the toner 7 is subjected to such a force that acts in the direction to supply the toner to the development roller 5.

However, this force is insufficient to supply the development roller 5 with a proper amount of the toner 7 for the following reason. That is, even though the toner 7 is such toner that is negative in inherent polarity, the amount of the average electrical charge which the toner 7 carries is relatively small, unless the toner 7 is charged with the use of some kind of charging means. Thus, when the potential difference is no more than the discharge threshold voltage, the amount of the force to which the toner 7 is subjected by the electrical field created between the toner supplying member 20 and development roller 5 is relatively small. Therefore, the amount by which the improvement is made in terms of the efficiency with which the development roller 5 is supplied with the toner 7, by providing the potential difference between the toner supplying member 20 and development roller 5 is not substantial. More specifically, the number of times the development roller 5 had to be rotated in order to restore the toner layer on the development roller 5 to the satisfactory condition after the consumption of the toner layer was two times, when the potential difference was provided between the toner supplying member 20 and development roller 5, whereas it was three times when no potential difference was provided between the toner supplying member 20 and development roller 5. In other words, even if a difference in potential is provided between the toner supplying member 20 and development roller 5, the development roller 5 is not continuously supplied with a satisfactory amount of the toner 7, as long as the potential difference provided between the toner supplying member 20 and development roller 5 is no more than the discharge threshold voltage.

As the potential difference is increased past the discharge threshold voltage, a substantial mount of negative current begins to flow from the toner supplying member 20 to the development roller 5, and also, the toner 7 begins to be attracted to from the toner supplying member side to the development roller side, remarkably increasing the amount by which the toner 7 is supplied to the development roller 5. As a result, the toner layer on the peripheral surface of the development roller 5 is immediately replenished with the toner 7 after the consumption of the toner 7 on the development roller 5. In other words, the development roller 5 is continuously supplied with a satisfactory amount of the toner 7.

The mechanism of the flow of negative current from the toner supplying member 20 to the development roller 5 is thought to be as follows. That is, when the potential difference between the toner supplying member 20 and development roller 5 is no less than the discharge threshold voltage, the gases in the air in the body of the toner between the development roller 5 and toner supplying member 20 is ionized. The positive ions lose their charge as they collide with the toner supplying member 20, whereas the negative ions move toward the development roller 5, negatively charging the toner 7 as they collide with the toner 7. The negative ions which did not collide with the toner 7 reach the development roller 5 and lose their charge. This seems to be the mechanism which induces electrical current.

The reason why the efficiency with which the development roller 5 is supplied with the toner 7 suddenly increases is thought to be as follows. That is, the electrical discharge suddenly increases the ratio of the charged toner 7 in the body of the toner in the adjacencies of the toner supplying member 20, suddenly increasing thereby the amount of the pressure applied to the body of the toner 7 by the electric field formed between the development roller 5 and toner supplying member 20, in the direction to move the body of the toner 7 toward the development roller 5. As a result, the toner 7 suddenly begins to flow toward the development roller 5, by a larger amount; the amount by which the development roller 5 is supplied with the toner 7 suddenly increase.

Figure 7:
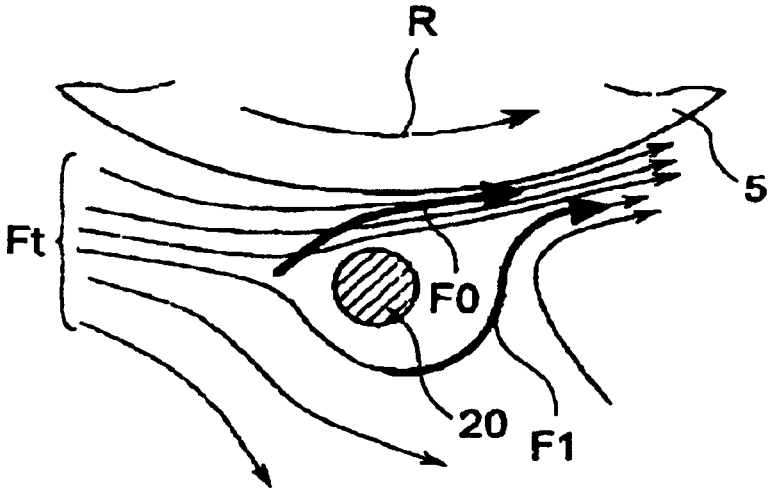
FIG. 7 is a schematic sectional view for depicting the role of the toner supplying member in the toner supplying process.

To describe in more detail with reference to FIG. 7, which schematically shows the pattern of the toner flow which occurs between the development roller 5 and toner supplying member 20 when the potential difference between the development roller 5 and toner supplying member 20 is no less than the discharge threshold voltage, when the potential difference between the development roller 5 and toner supplying member 20 is no less than discharge threshold voltage, the toner 7 in the adjacencies of the toner supplying member 20 is charged, being thereby pressured toward the development roller 5 by the electric field. Thus, even if voids are created along the peripheral surface of the development roller 5 due to the consumption of the toner 7 thereon, the toner supplying flow $F_0$ is immediately formed between the development roller 5 and toner supplying member 20 by the charged toner 7, and then, the toner supplying flow $F_1$ is created on the downstream side of the toner supplying member 20. The pressure which acts in the direction to supply the development roller 5 with the toner 7 is thought to be increased by the combination of these toner supplying flows $F_0$ and $F_1$, making it possible to continuously supply the development roller 5 with a satisfactory amount of the toner 7.

As will be evident from the above description, in order for the development roller 5 to be supplied with a satisfactory amount of the toner 7 by the toner supplying member 20, it is important for the following two conditions to be satisfied:

(1) The toner 7 in the adjacencies of the toner supplying member 20 is properly charged; and (2) The electric field is provided to pressure the charged toner 7 toward the development roller 5.

Here, a case in which such toner as the toner in this embodiment that is negative in inherent polarity is used as developer will be described. In a case in which the toner 7 is such toner that is positive in inherent polarity, the potential difference to be provided between the toner supplying member 20 and development roller 5 should be such a difference that is created by setting the potential levels of the toner supplying member 20 and development roller 5 so that the value of the potential of the toner supplying member 20 is on the positive side of the value of the potential level of the development roller 5. In comparison, in a case in which the toner 7 is such toner that is negative in inherent polarity, as is in this embodiment, the potential difference to be provided between the toner supplying member 20 and development roller 5 is created by setting the potential levels of the toner supplying member 20 and development roller 5 so that the value of the potential of the toner supplying member 20 is on the negative side of the value of the potential of the development roller 5. In other words, when the inherent polarity of the toner 7 is positive, the difference in potential between the toner supplying member 20 and development roller 5 has only to be established to be opposite to that established when the inherent polarity of the toner 7 is negative. Even when toner positive in inherent polarity is used, there is a discharge threshold voltage as there is when toner negative in inherent polarity is used. Thus, even if toner positive in inherent polarity is used, the development roller 5 can be continuously supplied with a satisfactory amount of the toner 7 as long as the potential levels of the toner supplying member 20 and development roller 5 are set so that the potential difference between the toner supplying member 20 and development roller 5 becomes greater than the discharge threshold voltage, that is, large enough to cause current to flow from the toner supplying member 20 to the development roller 5.

In consideration of the need for charging the toner 7 by the above described electrical discharge, and also, the need for creating the electric field for causing the charged toner 7 to induce the toner supplying flows $F_0$ and $F_1$, the potential difference between the toner supplying member 20 and development roller 5 is desired to be such a difference that induces DC current.

The following are discoveries made through the detailed studies of the experiments carried out to test the above described developing apparatus 4, in this embodiment, equipped with the above described toner supplying member 20, in terms of toner supplying performance and image quality.

The toner 7 was filled into the developer container 8 by the amount enough to fill the adjacencies of the toner supplying member 20. The potential difference between the development roller 5 and toner supplying member 20 was set to a value no more than the discharge threshold voltage (1,210 V in this embodiment), for example, 1,000 V. Then, images with the image ratio of 100%, that is, solid images (print ratio of 100%) were printed. The first print (image formed on first recording medium P) showed distinctive difference in density between the leading and trailing edges of the image, proving that the amount by which the development roller 5 was supplied with the toner 7 was not sufficient. In comparison, when 10 copies were continuously made, with the aforementioned potential difference set to 2,000 V to cause 100 $\mu$A of current to flow from the development roller 5 to the toner supplying member 20, none of the 10 copies showed a density difference large enough to be problematic, between the leading and trailing edges of the image, and also, the first copy and $10^{th}$ copy were not much different in density.

However, in the case of a developing apparatus such as the above described developing apparatus 4 set up to induce electrical discharge between the development roller 5 and toner supplying member 20, defective images were sometimes formed; for example, an image suffering from vertical streaks (streaks extending in direction in which recording medium P is conveyed), an image nonuniform in density, an image suffering from fog which is created as toner particles are adhered to the unintended points of the recording medium P, etc.

In consideration of the above described problems, the inventors of the present invention intensively studied the results further, making the following discoveries:

the occurrence of the density anomaly in the form of the aforementioned vertical streaks could be prevented by satisfying the following inequality:

$$R1/R2<15 \quad (1)$$

R1 (Ω): resistance of development roller 5 when 0.04 Vp [μA] of current is flowed to the development roller 5;

R2 (Ω): resistance of development roller 5 when 4 Vp [μA] of current is flowed to the development roller 5.

The formation of the above described fog could be prevented by satisfying the following inequality:

$$0.8<V2<V1<1.2 \quad (2)$$

V1: potential level of the metallic core (core member, substrate layer) as the electrically conductive substrate Or the development roller 5 when 4 Vp [μA] of current is flowed to the development roller 5;

V2: surface potential level of the development roller 5 in the development station N.

Figure 8:
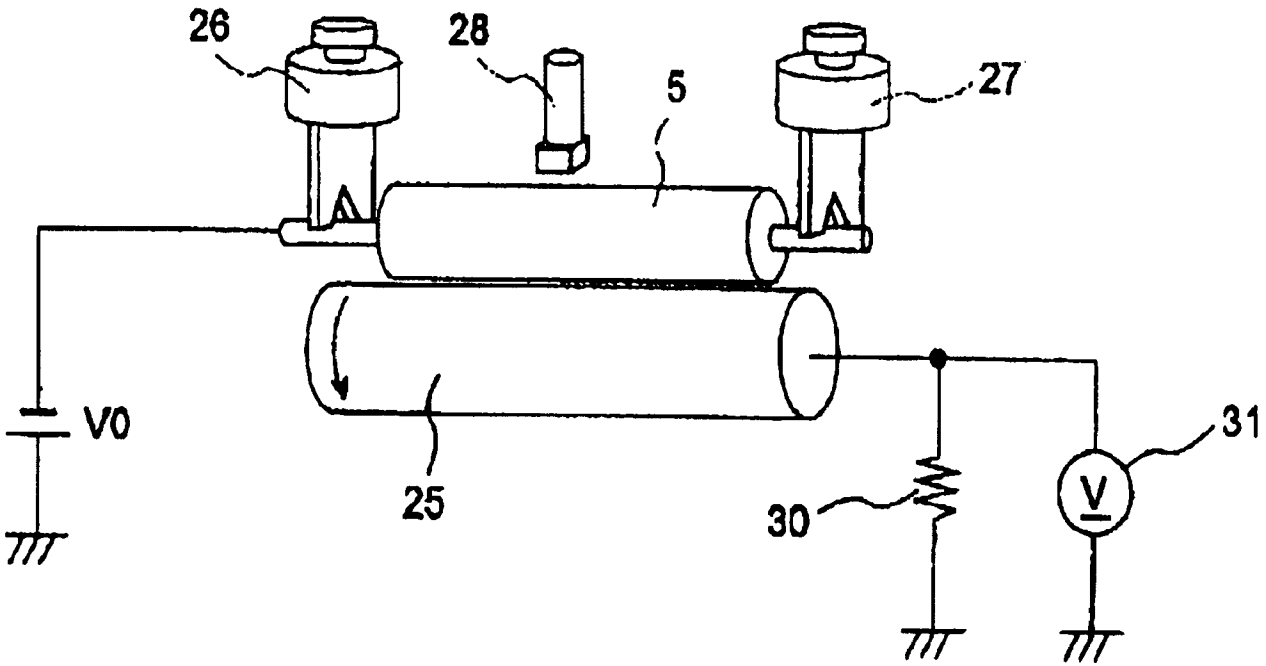
FIG. 8 is a schematic drawing for describing the apparatus for measuring the properties of the development roller.

FIG. 8 shows the schematic drawing of the apparatus for measuring the resistances R1 and R2 (Ω) of the development roller 5. This measuring instrument is provided with an electrically conductive metallic cylinder (metallic drum) 25 formed of aluminum or the like. This metallic drum 25 is rotated in the direction indicated by an arrow mark in the drawing at the peripheral velocity equivalent to the peripheral velocity Vp [mm/s] of the development roller 5. The diameter or the metallic drum 25 was 30 mm. The resistances R1 and R2 of the development roller 5 were measured when it peripheral velocity Vp was 50 mm/sec, and 100 mm/sec.

The development roller 5 was kept pressed upon the metallic drum 25 by the pressing means 26 and 27, and was rotated by the rotation of the metallic drum 25 at a peripheral velocity virtually equal to the peripheral velocity of the metallic drum 25. In this embodiment, the pressure applied to the development roller 5 is a total of 1 kgf (=9.8 N), that is, 500 gf per lengthwise end of the development roller 5.

To the metallic core or the development roller 5, a bias power source (high voltage power source 610C: TREK Co., Ltd.,) is connected, supplying thereby the development roller 5 with electric power. The metallic drum 25 is grounded through the electrical resistor 30, and the voltage between the two ends of the electrical resistor 30 is measured with a voltmeter 31 (Pen-recorder LR800: Yokogawa Electric Co.). The resistance of the resistor 30 is desired to be in the range of 1–100 kΩ. In this embodiment, a resistor with a resistance of 100 kΩ is employed. The surface potential level of the development roller 5 was measured with a surface potential level sensor (surface potential level measuring instrument 344: TREK Co.) 28 positioned opposite side of the development roller 5 from the contact area between the development roller 5 and metallic drum 25.

The resistance of the development roller 5, and the amount or the current which flows through the development roller 5 can be calculated from the known voltage $V_0$ and the voltage Vr measured with the voltmeter 31; the resistance of the development roller 5 can be measured at any current value, by means of adjusting the value of $V_0$.

The resistance or the development roller 5 is desired to be measured at two current levels: 0.04 Vp [μA] and 4 Vp [μA].

More specifically, the toner on the peripheral surface of the development roller 5 passes the development station N while carrying 0.04 Vp [μC/s] of electric charge, per unit of time. Thus, when the development efficiency is 100%, virtually the entirety of 0.04 Vp [μA] of current functions as development current. Therefore, the resistance of the development roller 5 in the development station N can be known by measuring the resistance of the development roller 5 when the current which flows through the development roller 5 is 0.04 Vp [μA].

Through the intensive research, the inventors of the present invention discovered that the toner supplying member 20 discharges elections to the development roller 5, and the current generated by the discharge was used by 0.1–50% for charging the toner. It is reasonable to think that the typical level of efficiency at which the current generated by this discharge is used for charging the toner is 1% (which hereinafter will be referred to as "discharge efficiency"). The amount of the electric charge carried by the toner on the development roller 5 per unit of time is 0.04 Vp [μC/s]. Therefore, even when the development efficiency is 100% (when virtually entirety of toner on development roller 5 is consumed for development), virtually the entirety of the toner on the development roller 5 can be properly charged by flowing 4 Vp [μA] of current from the toner supplying member 20 to the development roller 5. Therefore, the resistance of the development roller 5 as seen from the toner supplying member 20 side can be known by measuring the resistance R2 of she development roller 5 when the current flowing to the development roller 5 is 4 Vp [μA].

After the accumulation of a large number of experiments and researches, the inventors of the present invention discovered the following. That is, R1/R2 could be used as an index for the fluctuations in the resistance of the development roller 5 caused by the current which flowed to the development roller 5. In other words, when this index was large, the electrical discharge from the toner supplying member 20 to the development roller 5 was less in uniformity, that is, the current leaked locally. As a result, the toner failed to be uniformly supplied to the development roller 5, resulting in the formation of such a defective image that suffers from streaks (extending in recording medium conveyance direction) attributable to the local current leaks.

When 4 Vp [μA] of current is flowing to the development roller 5, and the ratio of the surface potential level V2 (measured with potentiometer 28 of measuring instrument in FIG. 8) of the development roller 5, in the development station N, to the voltage V1 ($V_0$ in FIG. 8) of the metallic core of the development roller 5, that is, V2/V1, is small, the surface potential of the development roller 5 is affected in the development station N, by the voltage applied to the toner supplying member 20, causing the toner to adhere to unintended points (non-image areas) on the peripheral surface of the photosensitive drum 1. As a result, a foggy image is formed. In comparison, when V2/V1 is large, the peripheral surface of the development roller 5 is charged by the friction, images suffering from fog, images insufficient in density, and/or the like detective images are formed.

Hereinafter, variations or the developing apparatus in the first embodiment of the present invention will be described in more detail in comparison to developing apparatuses in accordance with the prior art.

In the following variations or the developing apparatus in the first embodiment of the present invention, nonmagnetic single-component toner with an average particle diameter of 7 μm was used as the toner 7. The light potential level and dark potential level of the photosensitive drum 1, the potential difference for development, were as described above. In all of the following versions of the developing apparatus in the first embodiment of the present invention, the bias applied to the toner supplying member 20 was adjusted so that roughly 100 μA of current would flow from the toner supplying member 20 to development roller 5 while an image was actually formed.

(Variation 1)

Figure 9:
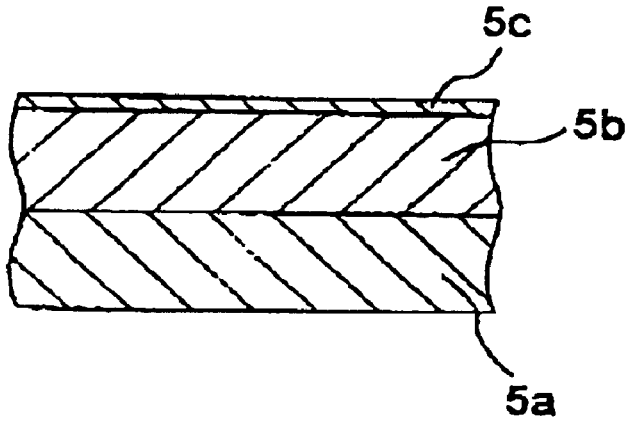
FIG. 9 a schematic sectional view of the functional layers of the development roller, showing the laminar structure thereof.
Figure 9:
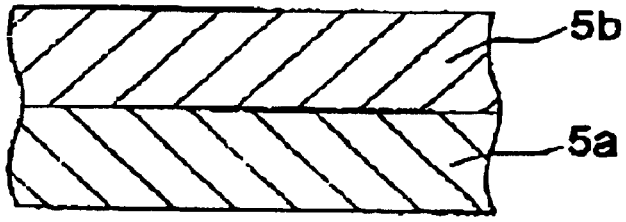

Referring to FIG. 9(*a*), the development roller 5 comprised a metallic core 5*a*, an elastic layer (resistive layer) formed on the peripheral surface of the metallic core 5*a*, and a urethane layer 5*c*, as the outermost layer, coated on the peripheral surface of the elastic layer 5*b*. The metallic core 5*a* was 8 mm in diameter and was formed of stainless steel. The elastic layer 5*b* was 4 mm in thickness and was formed of EPDM. Its resistance was in the medium range. The urethane layer was capable of conducting ions, and was 10 μm in thickness. Within the elastic layer 5*b*, that is, the EPDM layer 5*b*, carbon particles were dispersed. The form of conduction of the EPDM layer was the electron conduction. The above described development roller 5 was fitted in the developing apparatus 4 shown in FIG. 4, and the developing apparatus 4 was fitted in the image forming apparatus 100 shown in FIG. 1. Then, the image forming apparatus was operated at 100% print ratio and 0% print ratio, with the peripheral velocity Vp or the development roller 5 set at 50 mm/sec and 100 mm/sec.

When the peripheral velocity Vp of the development roller 5 was 50 mm/sec, the value of R1/R2 obtained using the above described measuring method was 5.10, whereas when the peripheral velocity Vp of the development roller 5 was 100 mm/sec, it was 5.50. As for the value of the V2/V1, it was 0.97 and 0.93 when the peripheral velocity Vp of the development roller 5 was 50 mm/sec and 100 mm/sec, respectively.

When the image forming apparatus was operated at a print ratio of 100%, images suffering from the aforementioned vertical streaks were formed whether the peripheral velocity of the development roller 5 was 50 mm/sec or 100 mm/sec. However, the amount of the streaks was within the acceptable range. Further, there was no problem as far as density was concerned. When the image forming apparatus was operated at a print ratio of 0%, fog was not generated whether the peripheral velocity of the development roller 5 was 50 mm/sec or 100 mm/sec.

(Variation 2)

Referring to FIG. 9(*b*), the development roller 5 comprised: a metallic core 5*a*, and an elastic layer (resistive layer) formed on the peripheral surface of the metallic core 5*a*. The metallic core 5*a* was 8 mm in diameter and was formed of stainless steel. The elastic layer 5*b* was 4 mm in thickness and was formed of rubber, more specifically, a blend of NBR and hydrin rubber, in which ion conductive particles were dispersed. Its resistance was in the medium range. The form of conduction of the EPDM layer was the ion conduction. The above described development roller 5 was fitted in the developing apparatus 4 shown in FIG. 4, and the developing apparatus 4 was fitted in the image forming apparatus 100 shown in FIG. 1. Then, the image forming apparatus was operated at print ratios or 100% and 0%, with the peripheral velocity Vp of the development roller 5 set at 50 mm/sec and 100 mm/sec.

When the peripheral velocity Vp of the development roller 5 was 50 mm/sec, the value of R1/R2 obtained using the above described measuring method was 1.12, whereas when the peripheral velocity Vp of the development roller 5 was 100 mm/sec, it was 1.19. As for the value of the V2/V1, it was 1.01 and 1.00 when the peripheral velocity Vp of the development roller 5 was 50 mm/sec and 100 mm/sec, respectively.

When the image forming apparatus was operated at a print ratio of 100%, formed images did not suffer any problem in terms of quality, in particular, density, whether the peripheral velocity of the development roller 5 was 50 mm/sec or 100 mm/sec When the image forming apparatus was operated at a print ratio of 0%, fog was not generated whether the peripheral velocity of the development roller 5 was 50 mm/sec or 100 mm/sec.

(Variation 3)

Referring to FIG. 9(*a*), the development roller 5 comprised: a metallic core 5*a*, an elastic layer (resistive layer) formed on the peripheral surface of the metallic core 5*a*, and a urethane layer 5*c* (resistive layer), as the outermost layer, coated on the peripheral surface of the elastic layer 5*b*. The metallic core 5*a* was 8 mm in diameter and was formed of stainless steel. The elastic layer 5*b* was 4 mm in thickness and was formed of rubber, more specifically, a blend of NBR and hydrin rubber, in which ion conductive agent was dispersed. The form of conduction of the elastic layer was the ion conduction. Its resistance was in the medium range. The urethane layer was capable of conducting ions, and was 10 μm in thickness. The above described development roller 5 was fitted in the developing apparatus 4 shown in FIG. 4, and the developing apparatus 4 was fitted in the image forming apparatus 100 shown in FIG. 1. Then, the image forming apparatus was operated at 100% print ratio and 0% print ratio, with the peripheral velocity Vp of the development roller 5 set at 50 mm/sec and 100 mm/sec.

When the peripheral velocity Vp of the development roller 5 was 50 mm/sec, the value of R1/R2 obtained using the above described measuring method was 0.99, whereas when the peripheral velocity Vp of the development roller 5 was 100 mm/sec, it was 1.18. As for the value of the V2/V 1, it was 0.99 and 1.00 when the peripheral velocity Vp of the development roller 5 was 50 mm/sec and 100 mm/sec, respectively.

When the print ratio was 100%, there was no problem regarding image quality and density, whether the peripheral velocity of the development roller 5 was 50 mm/sec or 100 mm/sec. Further, when the print ratio was 0%, no problem concerning fog occurred, whether the peripheral velocity or the development roller 5 was 50 mm/sec or 100 mm/sec.

(Variation 4)

Referring to FIG. 9(*b*), the development roller 5 comprised a metallic core 5*a*, and an elastic layer (resistive layer) formed on the peripheral surface of the metallic core 5*a*. The metallic core 5*a* was 8 mm in diameter and was formed of stainless steel. The elastic layer 5*b* was 4 mm in thickness and was formed of silicone rubber. Its resistance was in the medium range. Within the elastic layer 5*b*, that is, the silicone rubber layer 5*b*, carbon particles were dispersed.

The form of conduction of the silicone rubber layer was the electron conduction. The above described development roller 5 was fitted in the developing apparatus 4 shown in FIG. 4, and the developing apparatus 4 was fitted in the image forming apparatus 100 shown in FIG. 1. Then, the image forming apparatus was operated at printer ratios of 100% and 0%, with the peripheral velocity Vp of the development roller 5 set at 50 mm/sec and 100 mm/sec.

When the peripheral velocity Vp of the development roller 5 was 50 mm/sec, the value of R1/R2 obtained using the above described measuring method was 13.08, whereas when the peripheral velocity Vp of the development roller 5 was 100 mm/sec, it was 12.15. As for the value of the V2/V1, it was 0.98 and 0.99 when the peripheral velocity Vp of the development roller 5 was 50 mm/sec and 100 mm/sec, respectively.

When the print ratio was 100%, images showed a slightly larger amount of the vertical streaks than the images formed using the Variation 1 of the developing apparatus, whether the peripheral velocity Vp of the development roller 5 was 50 mm/sec or 100 mm/sec. However, the amount of the vertical streaks was still within the tolerable range. Also, there was no problem regarding density. Further, when the print ratio was 0%, no problem concerning fog occurred.

(Variation 5)

Referring to FIG. 9(*b*), the development roller 5 comprised a metallic core 5*a*, and an elastic layer (resistive layer) formed on the peripheral surface of the metallic core 5*a*. The metallic core 5*a* was 8 mm in diameter and was formed of stainless steel. The elastic layer 5*b* was 4 mm in thickness and was formed of rubber, more specifically, a blend of NBR and hydrin rubber. Its resistance was in the medium range. Within the elastic layer 5*b*, that is, the rubber layer 5*b*, ion conductive agent was dispersed. The conduction form of the rubber layer was the ions conduction. The above described development roller 5 was fitted in the developing apparatus 4 shown in FIG. 4, and the developing apparatus 4 was fitted in the image forming apparatus 100 shown in FIG. 1. Then, the image forming apparatus was operated at printer ratios of 100% and 0%, with the peripheral velocity Vp of the development roller 5 set at 50 mm/sec and 100 mm/sec.

When the peripheral velocity Vp of the development roller 5 was 50 mm/sec, the value of R1/R2 obtained using the above described measuring method was 1.23 whereas when the peripheral velocity Vp of the development roller 5 was 100 mm/sec, it was 127. As for the value of the V2/V1, it was 1.00 and 1.00 when the peripheral velocity Vp of the development roller 5 was 50 mm/sec and 100 mm/sec, respectively.

When the print ratio was 100%, images showed no problem as far as image quality (density) was concerned, whether the peripheral velocity Vp of the development roller 5 was 50 mm/sec or 100 mm/sec. Further, when the print ratio was 0%, no problem concerning fog occurred, whether the peripheral velocity of the development roller 5 was 50 mm/sec or 100 mm/sec.

(Variation 6)

Referring to FIG. 9(*b*), the development roller 5 comprised a metallic core 5*a*, and an elastic layer (resistive layer) formed on the peripheral surface of the metallic core 5*a*. The metallic core 5*a* was 8 mm in diameter and was formed of stainless steel. The elastic layer 5*b* was 4 mm in thickness and was formed of urethane. Its resistance was in the medium range. Within the elastic layer 5*b*, that is, the urethane layer 5*b*, ion conductive agent was dispersed. The form of conduction of the urethane layer was the ion conduction. The above described development roller 5 was fitted in the developing apparatus 4 shown in FIG. 4, and the developing apparatus 4 was fitted in the image forming apparatus 100 shown in FIG. 1. Then, the image forming apparatus was operated at printer ratios of 100% and 0%, with the peripheral velocity Vp of the development roller 5 set at 50 mm/sec and 100 mm/sec.

When the peripheral velocity Vp of ate development roller 5 was 50 mm/sec, the value of R1/R2 obtained using the above described measuring method was 2.02, whereas when the peripheral velocity Vp of the development roller 5 was 100 mm/sec, it was 2.33. As for the value of the V2/V1, it was 1.00 and 1.00 when the peripheral velocity Vp of the development roller 5 was 50 mm/sec and 100 mm/sec, respectively.

When the print ratio was 100%, images showed no problem in quality, in particular, density, whether the peripheral velocity of the development roller 5 was 50 mm/sec or 100 mm/sec. Further when the print ratio was 0%, there was no problem concerning fog, whether the peripheral velocity of the development roller 5 was 50 mm/sec or 100 mm/sec.

(Comparative Sample 1)

Referring to FIG. 9(*a*), the development roller 5 comprised a metallic core 5*a*, an elastic layer (resistive layer) formed on the peripheral surface of the metallic core 5*a*, and a urethane layer 5*c*, (resistive layer), as the outermost layer, coated on the peripheral surface of the elastic layer 5*b*. The metallic core 5*a* was 8 mm in diameter and was formed of stainless steel. The elastic layer 5*b* was 4 mm in thickness and was formed of silicone rubber, in which carbon particles were dispersed. Its resistance was in the medium range. The form of conduction of the silicon rubber layer was the electron conduction. The outermost layer 5*c*, that is, the urethane layer, was 10 $\mu$m in thickness. Within the urethane layer 5*c*, carbon particles were dispersed, enabling the urethane layer to conduct electrons. The above described development roller 5 was fitted in the developing apparatus 4 shown in FIG. 4, and the developing apparatus 4 was fitted in the image forming apparatus 100 shown in. FIG. 1. Then, the image forming apparatus was operated at print ratios of 100% and 0%, with the peripheral velocity Vp of the development roller 5 set at 50 mm/sec and 100 mm/sec.

When the peripheral velocity Vp of the development roller 5 was 50 mm/sec, the value of R1/R2 obtained using the above described measuring method was 38.25, whereas when the peripheral velocity Vp of the development roller 5 was 100 mm/sec, it was 15.42. As for the value of the V2/V1, it was 0.67 and 0.74 when the peripheral velocity Vp of the development roller 5 was 50 mm/sec and 100 mm/sec, respectively.

When the image forming apparatus was operated at a print ratio of 100%, the aforementioned vertical streaks were definitely more conspicuous than those seen on the images formed using the Variation 5, whether the peripheral velocity of the development roller 5 was 50 mm/sec or 100 mm/sec, and so was the nonuniformity in density. Further, image density was higher. When the print ratio was 0%, fog was conspicuous, whether the peripheral velocity of the development roller 5 was 50 mm/sec or 100 mm/sec.

(Comparative Sample 2)

Referring to FIG. 9(*a*), the development roller 5 comprised a metallic core 5*a*, an elastic layer (resistive layer) formed on the peripheral surface of the metallic core 5*a*, and a urethane layer (resistive layer) 5*c*, as the outermost layer, coated on the peripheral surface of the elastic layer 5*b*. The metallic core 5*a* was 8 mm in diameter and was formed of stainless steel. The elastic layer 5*b* was 4 mm in thickness and was formed of rubber, more specifically, a blend of NBR and hydrin rubber, in which ion conduction agent was dispersed. Its resistance was in the medium range. The form of conduction of the rubber layer was the ion conduction The urethane layer 5*c*, in which carbon particles were dispersed, was capable of conducting electrons, and was 10 μm in thickness. The above described development roller 5 was fitted in the developing apparatus 4 shown in FIG. 4, and the developing apparatus 4 was fitted in the image forming apparatus 100 shown in FIG. 1. Then, the image forming apparatus was operated at print ratios of 100% and 0%, with the peripheral velocity Vp of the development roller 5 set at 50 mm/sec and 100 mm/sec.

When the peripheral velocity Vp of the development roller 5 was 50 mm/sec, the value of R1/R2 obtained using the above described measuring method was 1.93, whereas when the peripheral velocity Vp of the development roller 5 was 100 mm/sec, it was 1.83. As for the value of the V2/V1, it was 0.62 and 0.59 when the peripheral velocity Vp of the development roller 5 was 50 mm/sec and 100 mm/sec, respectively.

When the print ratio was 100%, the aforementioned vertical streaks did not occur, whether the peripheral velocity Vp of the development roller 5 was 50 mm/sec or 100 mm/sec. However, density was high. When the print ratio was 0%, fog was conspicuous, whether the peripheral velocity Vp or the development roller 5 was 50 mm/sec or 100 mm/sec.

(Comparative Sample 3)

Referring to FIG. 9(*b*), the development roller 5 comprised a metallic core 5*a*, and an elastic layer (resistive layer) formed on the peripheral surface of the metallic core 5*a*. The metallic core 5*a* was 8 mm in diameter and was formed of stainless steel. The elastic layer 5*b* was 4 mm in thickness and was formed of silicone rubber. Its resistance was in the medium range. Within the elastic layer 5*b*, that was, the silicone rubber layer 5*b*, carbon particles were dispersed. The form of conduction of the silicone rubber layer was the electron conduction. The above described development roller 5 was fitted in the developing apparatus 4 shown in FIG. 4, and the developing apparatus 4 was fitted in the image forming apparatus 100 shown in FIG. 1. Then, the image forming apparatus was operated at printer ratios of 100% and 0%, with the peripheral velocity Vp of the development roller 5 set at 50 mm/sec and 100 mm/sec.

When the peripheral velocity Vp of the development roller 5 was 50 mm/sec, the value of R1/R2 obtained using the above described measuring method was 15.10, whereas when the peripheral velocity Vp of the development roller 5 was 100 mm/sec, it was 16.79. As for the value of the V2/V1, it was 0.83 and 0.84 when the peripheral velocity Vp of the development roller 5 was 50 mm/sec and 100 mm/sec, respectively.

When the print ratio was 100%, images showed the vertical streaks, whether the peripheral velocity Vp of the development roller 5 was 50 mm/sec or 100 mm/sec. However, the nonuniformity in density was conspicuous, although there was no problem in terms of the maximum density. When the print ratio was 0%, there was no problem concerning fog, whether the peripheral velocity or the development roller 5 was 50 mm/sec or 100 mm/sec.

(Comparative Sample 4)

Referring to FIG. 9(*a*), the development roller 5 comprised a metallic core 5*a*, an elastic layer (resistive layer) formed on the peripheral surface of the metallic core 5*a*, and a Nylon layer (resistive layer) 5*c*, as the outermost layer, placed on the peripheral surface of the elastic layer 5*b*. The metallic core 5*a* was 8 am in diameter and was formed of stainless steel. The elastic layer 5*b* was 4 mm in thickness and was formed of silicone rubber, in which carbon particles were disposed. Thus, the form of conduction of the elastic layer was electron conduction. The resistance of the elastic layer 5*b* was in the medium range. The outermost layer 5*c* was in the form of a tube formed of Nylon in which carbon particles were dispersed, being therefore capable of conducting electrons. It was 30 μm in thickness. The above described development roller 5 was fitted in the developing apparatus 4 shown in FIG. 4, and the developing apparatus 4 was fitted in the image forming apparatus 100 shown in FIG. 1. Then, the image forming apparatus was operated at print ratios of 100% and 0%, with the peripheral velocity Vp of the development roller 5 set at 50 mm/sec 100 mm/sec.

When the peripheral velocity Vp of the development roller 5 was 50 mm/sec, the value of R1/R2 obtained using the above described measuring method was 17.61, whereas when the peripheral velocity Vp of the development roller 5 was 100 mm/sec, it was 18.00. As for the value of the V2/V1, it was 1.30 and 1.22 when the peripheral velocity Vp of the development roller 5 was 50 mm/sec and 100 mm/sec, respectively.

When the print ratio was 100%, the aforementioned vertical streaks occurred, whether the peripheral velocity Vp of the development roller 5 was 50 mm/sec or 100 mm/sec. Further, the nonuniformity in density was conspicuous, although there was no problem in terms of the maximum density. When the print ratio was 0%, fog was conspicuous, whether the peripheral velocity Vp of the development roller 5 was 50 mm/sec or 100 mm/sec.

(Comparative Sample 5)

Referring to FIG. 9(*a*), the development roller 5 comprised a metallic core 5*a*, an elastic layer (resistive layer) formed on the peripheral surface of the metallic core 5*a*, and a Nylon layer resistive layer) 5*c*, as the outermost layer, placed on the peripheral surface of the elastic layer 5*b*. The metallic core 5*a* was 8 mm in diameter and was formed of stainless steel. The elastic layer 5*b* was 4 mm in thickness and was formed of rubber, more specifically, a blend of NBR and hydrin rubber, in which ion conduction agent was dispersed. Thus, the form of conduction of the elastic layer 5*b* was ion conduction. The resistance of the elastic layer 5*b* was in the medium range. The outermost layer 5*c* was in the form of a tube formed of Nylon in which carbon particles were dispersed, being therefore capable or conducting electrons. It was 30 μm in thickness. The above described development roller 5 was fitted in the developing apparatus 4 shown in FIG. 4, and the developing apparatus 4 was fitted in the image forming apparatus 100 shown in FIG. 1. Then, the image forming apparatus was operated at print ratios of 100% and 0%, with the peripheral velocity Vp of the development roller 5 set at 50 mm/sec and 100 mm/sec.

When the peripheral velocity Vp of the development roller 5 was 50 mm/sec, the value of R1/R2 obtained using the above described measuring method was 4.65, whereas when the peripheral velocity Vp of the development roller 5 was 100 mm/sec, it was 4.73. As for the value of the V2/V1, it was 0.26 and 0.22 when the peripheral velocity Vp of the development roller 5 was 50 mm/sec and 100 mm/sec, respectively.

When the print ratio was 100%, the aforementioned vertical streaks did not occur, whether the peripheral velocity Vp of the development roller 5 was 50 mm/sec or 100 mm/sec. However, when the print ratio was 0%, fog was conspicuous, whether the peripheral velocity Vp of the development roller 5 was 50 mm/sec or 100 mm/sec.

TABLE 1

| | BASE | SUR. | RESISTANCE 2 μA | RESISTANCE 200 μA | R1/R2 | V2/V1 | *1 | *2 |
|---|---|---|---|---|---|---|---|---|
| EX. 1 | *3 | *7 | 1.42E+07 | 2.79E+06 | 5.10 | 0.97 | F | G |
| EX. 2 | *4 | — | 8.33E+05 | 7.43E+05 | 1.12 | 1.01 | G | G |
| EX. 3 | *4 | *7 | 1.40E+06 | 1.42E+06 | 0.99 | 0.99 | G | G |
| EX. 4 | *5 | — | 1.66E+07 | 1.27E+06 | 13.08 | 0.98 | G | G |
| EX. 5 | *4 | — | 3.43E+06 | 2.80E+06 | 1.23 | 1.00 | F | G |
| EX. 6 | *6 | — | 1.54E+07 | 7.60E+06 | 2.02 | 1.00 | G | G |
| COMP. EX. 1 | *5 | *8 | 1.53E+07 | 4.00E+05 | 38.25 | 0.67 | N | N |
| COMP. EX. 2 | *4 | *8 | 6.23E+06 | 3.23E+06 | 1.93 | 0.62 | G | N |
| COMP. EX. 3 | *5 | — | 2.26E+07 | 1.50E+06 | 15.10 | 0.83 | N | G |
| COMP. EX. 4 | *5 | *9 | 1.06E+07 | 6.00E+05 | 17.61 | 1.30 | N | N |
| COMP. EX. 5 | *4 | *9 | 1.89E+07 | 4.07E+06 | 4.65 | 0.26 | G | N |

Vp = 50 mm/s
G: Good,
F: Fair,
N: No good
*1: STRIPE,
*2: FOGLESS
*3: EPDM,
*4: NBR/HYDRIN,
*5: SILICONE,
*6: URETHANE
*7: URETHANE (ION CONDUCTION),
*8: URETHANE (ELECTRON CONDUCTION)
*9: NYLON (ELECTRON CONDUCTION)

TABLE 2

| | BASE | SUR. | RESISTANCE 2 μA | RESISTANCE 200 μA | R1/R2 | V2/V1 | *1 | *2 |
|---|---|---|---|---|---|---|---|---|
| EX. 1 | *3 | *7 | 1.16E+07 | 2.10E+06 | 5.50 | 0.93 | F | G |
| EX. 2 | *4 | — | 8.33E+05 | 7.00E+05 | 1.19 | 1.00 | G | G |
| EX. 3 | *4 | *7 | 1.57E+06 | 1.33E+06 | 1.18 | 1.00 | G | G |
| EX. 4 | *5 | — | 1.07E+07 | 8.83E+05 | 12.15 | 0.99 | G | G |
| EX. 5 | *4 | — | 3.23E+06 | 2.55E+06 | 1.27 | 1.00 | F | G |
| EX. 6 | *6 | — | 1.43E+07 | 6.15E+06 | 2.33 | 1.00 | G | G |
| COMP. EX. 1 | *5 | *8 | 3.65E+06 | 2.37E+05 | 15.42 | 0.74 | N | N |
| COMP. EX. 2 | *4 | *8 | 5.57E+06 | 3.05E+06 | 1.83 | 0.59 | G | N |
| COMP. EX. 3 | *5 | — | 1.62E+07 | 9.67E+05 | 16.79 | 0.84 | N | G |
| COMP. EX .4 | *5 | *9 | 6.90E+06 | 3.83E+05 | 18.00 | 1.22 | N | N |
| COMP. EX. 5 | *4 | *9 | 1.61E+07 | 3.40E+06 | 4.73 | 0.22 | G | N |

Vp = 100 mm/s
G: Good,
F: Fair,
N: No good
*1: STRIPE,
*2: FOGLESS,
*3: EPDM,
*4: NBR/HYDRIN,
*5: SILICONE,
*6: URETHANE
*7: URETHANE (ION CONDUCTION),
*8: URETHANE (ELECTRON CONDUCTION)
*9: NYLON (ELECTRON CONDUCTION)

Given in Tables 1 and 2 are the summaries of the performances of the above described Variations 1–6 and Comparative Samples 1–5. Table 1 represents the tests in which Vp=50 mm/sec, and Table 2 represents the tests in which Vp=100 mm/sec.

Figure 10:
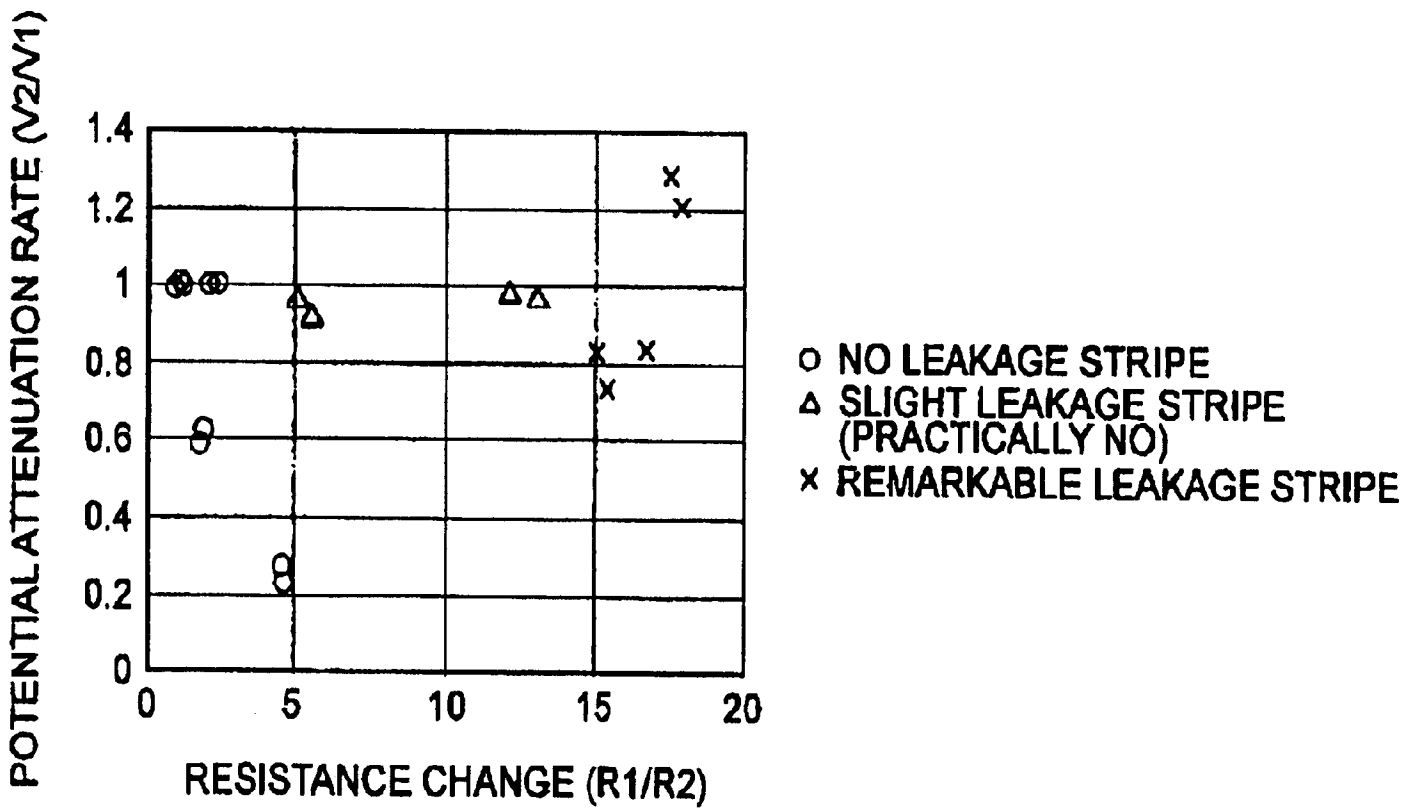
FIG. 10 is a graph showing the effects of the changes in the resistance (R1/R2) and electrical potential attenuation ratio (V2/V1), upon the formation of an image suffering from the streaks attributable to current leaks.

FIG. 10 is a graph in which the evaluations of the streaks attributable to the current leaks are plotted, and in which the axes of abscissas and ordinates represent the R1/R2 and potential attenuation factor V2/V1, respectively. It shows both the performances when the Vp=50 mm/sec and the performances when Vp=100 mm/sec. In the graph, G means that the streaks attributable to the current leaks did not occur; F means the presence of the streaks, the amount of which is within the tolerable range; and N means that the streaks are conspicuous.

The following are evident from FIG. 10. That is, in order to reduce the possibility of the occurrence of the streaks attributable to the current leak, the aforementioned resistances R1 (Ω) and R2 (Ω) of the development roller 5 are desired to be set to satisfy the following inequality:

$$R1/R2<15 \quad (1)$$

Also in order to further reduce the possibility of the occurrence of the streaks attributable to the current leaks, the resistances R1 and R2 are desired to be set to satisfy the following inequality:

$$R1/R2<5 \quad (3).$$

Referring to Tables 1 and 2, in the case of each of the above described variations, the fluctuation of R1/R2 was no more than 20% both when the Vp=50 mm/sec, and when the Vp=100 mm/sec, and the fluctuation of V2/V1 was no more than 5% both when Vp=50 mm/sec and when Vp was 100 mm/sec.

According to the studies made by the inventors of the present invention, the value of R1/R2 is affected by the amount of the flowed current. But the range in which the value of R1/R2 changes is small. In other words, R1/R2 can be used as a reliable index. For example, R1/R2 can be satisfactorily used as the index for anti-leak performance. It is obviously meaningful to measure the resistance of the development roller 5 when the amount of the current which flows to the development roller 5 is 0.04 Vp [μA] and 4 Vp [μA] as representative values. In reality, however, the amount of the development current which flows in the developing apparatus is not limited to 0.04 Vp. Similarly, the current which flows from the toner supplying member 20 is not limited to 4 Vp. Not only may it be obviously no more than 4 Vp, but also no less than 4 Vp.

As for the electrically conductive elastic substances for the development roller 5, which are capable of satisfying the aforementioned inequality (1): R1/R2<5, there are a combination of rubber, and electrical conductor dispersed therein, a combination of high polymer, and electrical conductor dispersed therein, etc. As the rubber, there are EPDM (ethylene-propylene-diene-terpolymer), polybutadiene, natural rubber, polyisoprene, SBR (styrene-butadiene rubber), CR (chloroprene rubber), NBR (nitrile-butadiene rubber). As the high polymers, there are polystyrene resins, for example, RB (butadiene resion), SBS (styrene-butadiene-styrene elastomer), etc., polyolefin resins, polyester resins, polyurethane, PE (polyethylene), PP (polypropylene), PVC (polyvinyl chloride), acrylic resins, copolymer of styrene and vinyl acetate, copolymer of butadiene and acrylonitrile, etc.

As the conductive agent, there are: carbon black, graphite; metallic oxides, such as $TiO_2$, $SnO_2$, $Sb_2O_5$, and ZnO; metals, such as Cu and Ag; electrically conductive particles formed by coating particles with electrically conductive substance; etc. However, from the standpoint of reducing the value of R1/R2, substances which can provide the development roller 5 with a conduction mechanism of the ion conduction type are preferable. As for such substances, ionic electrolytes, for example, $LiClO_4$, KSCN, NaSCN, LiSCN, $LiCF_3SO_3$, etc., are suitable. It is also possible to introduce polar molecule(s) or polar atomic group(s) into the principal or side chain of polymer, in order to provide conductivity Further, in order to satisfy the above described inequality (3): R1/R2<5, not only is it desired to use, as the conductive agent, one of the ionic substances among the above listed conductive agents, but also, it is desired to use, as the base material, one of the above listed base materials, in particular, one of the polar substances, for example, acrylonitrile-butadiene rubber (NBR), hydrated NBR (H-NBR); copolymer of NBR and third component, such as isoprenel, denatured NBR created by introducing a functional group such as carboxyl group, into NBR, nitrile rubber such as NBR cross-linked internally at butadiene portion, copolymer of ethylene oxide and propylene oxide, alkyl-ether polymer such as copolymer of ethylene oxide-propylene oxide-allyl glycidyl ether, hydrin rubber such as epychlorohydrin rubber (CO), copolymer (rubber) of epichlorohydrin and ethylene oxide (ECO), copolymer (rubber) of epychlorohydrin-ethylene oxide-allyl glycidyl ether, urethane rubber, chloroprene rubber, chlorosulfonated polyethylene rubber, etc. Among the above listed materials, the materials which are low in electrical resistance by themselves, are preferable; for example, hydrin rubber such as CO, ECO, nitrile rubber such as NBR, H-NBR, and alkyl ether group polymer such as copolymer of ethylene oxide-propylene oxide and ethylene oxide-propylene oxide-allyl glycidyl ether.

Incidentally, the value of resistance R2 is desired to be no less than $1\times10^5$ Ω for the following reason. That is, even when the inequality: R1/R2<15 is satisfied, and current leak is under control, if the value of resistance R2 is smaller than a certain value, current leak occurs between the metallic core 5*a* of the development roller 5 and toner supplying member 20, through a the portions of the development roller 5, which are relatively low in electrical resistance, while voltage higher than the discharge threshold voltage is applied to the toner supplying member 20. This current leak results in the formation of an image which is nonuniform in density, more specifically, an image suffering from streaks perpendicular to the recording medium conveyance direction (which hereinafter may be referred to as "horizontal streaks").

For example, when the development roller 5 in Variation 4, R2 of which had been made to be $8\times10^4$ Ω by increasing the amount by which electrical conductor was dispersed in the elastic layer of the development roller 5, was used, current leaked in the circumferential direction, the areas lower in electrical resistance, even when the value of R1/R2 was 13. As a result, a defective image, more specifically, an image suffering from the aforementioned horizontal streaks was formed.

The bottom limit of the resistance of the development roller 5 is related to the current leak between the toner supplying member 20 and development roller 5. Therefore, it is desired to measure the value of the resistance R2 instead of the resistance R1, because the resistance R2 is such a resistance that is measured in the condition, which is closer to the actual condition in which the development roller 5 is used, and in which a relatively large amount of current flows.

When the resistance R1 is higher, more specifically, when the value of the resistance R1 is no less than $1\times10^8$ Ω, the discharge threshold voltage is also higher, making it sometimes necessary for the potential difference between the toner supplying member 20 and development roller 5 to be no less than 6 kV. In this condition, if a development roller 5 such as those in the preceding variations, the elastic layer (resistive layer) 5*b* or which was 4 mm is used, the body of air between the toner supplying member 20, and the portions of the metallic core 5*a* which are not covered with the elastic layer (resistive layer) 5*b*, is not sufficient to prevent the occurrence of electrical discharge between the metallic core 5*a* and toner supplying member 20. When a development roller, the resistance R1 of which was $1.3\times10^6$ when the Vp=100 mm/sec, was used as the development roller 5, the discharge threshold voltage was roughly 2,000 V, and the current leak attributable to puncture occurs when the potential level between the development roller 5 and toner supplying member 20 was set to 6 kV. In other words, the potential difference could not be increased beyond 6 kV, making it impossible to supply the development roller 5 with a satisfactory amount of the toner 7.

When the development roller 5, the elastic layer 5*b* of which was no less than 10 mm in thickness, was used in the normal environment, the puncture did not occur even when the potential difference was as high as roughly 10 kV, as long as it was used in the normal environment. However, when it was used in the high temperature-high humidity environment (32° C. in temperature and 80% in relative humidity), the puncture occurred along the peripheral surfaces, making it impossible to raise the potential difference beyond roughly 10 kV, and therefore, it was impossible to supply the development roller 5 with a satisfactory amount or the toner 7. Besides, increasing the thickness of the elastic layer 5*b* of the development roller 5 makes the development roller 5 larger. In other words, either way, increasing the thickness of the elastic layer 5*b* beyond 10 mm is not desirable.

Regarding the top limit for the resistance of the development roller 5, if it is set with reference to the resistance R2, which is measured while a relatively large amount is flowed, there is the possibility of the current leaks through the above described space or along the peripheral surface the development roller. Therefore, it is desired to be set with reference to the resistance R1, which is measured while a relatively small amount of current is flowed, that is, while the amount of the applied voltage is relatively small.

As will be evident from the above description, not only is it desired for the resistance R1 to satisfy the following inequality:

$$R1<10^8\ \Omega$$

but also, it is desired for the resistance R2 to satisfy the following inequality:

$$10^5\ \Omega\leqq R2.$$

Figure 11:
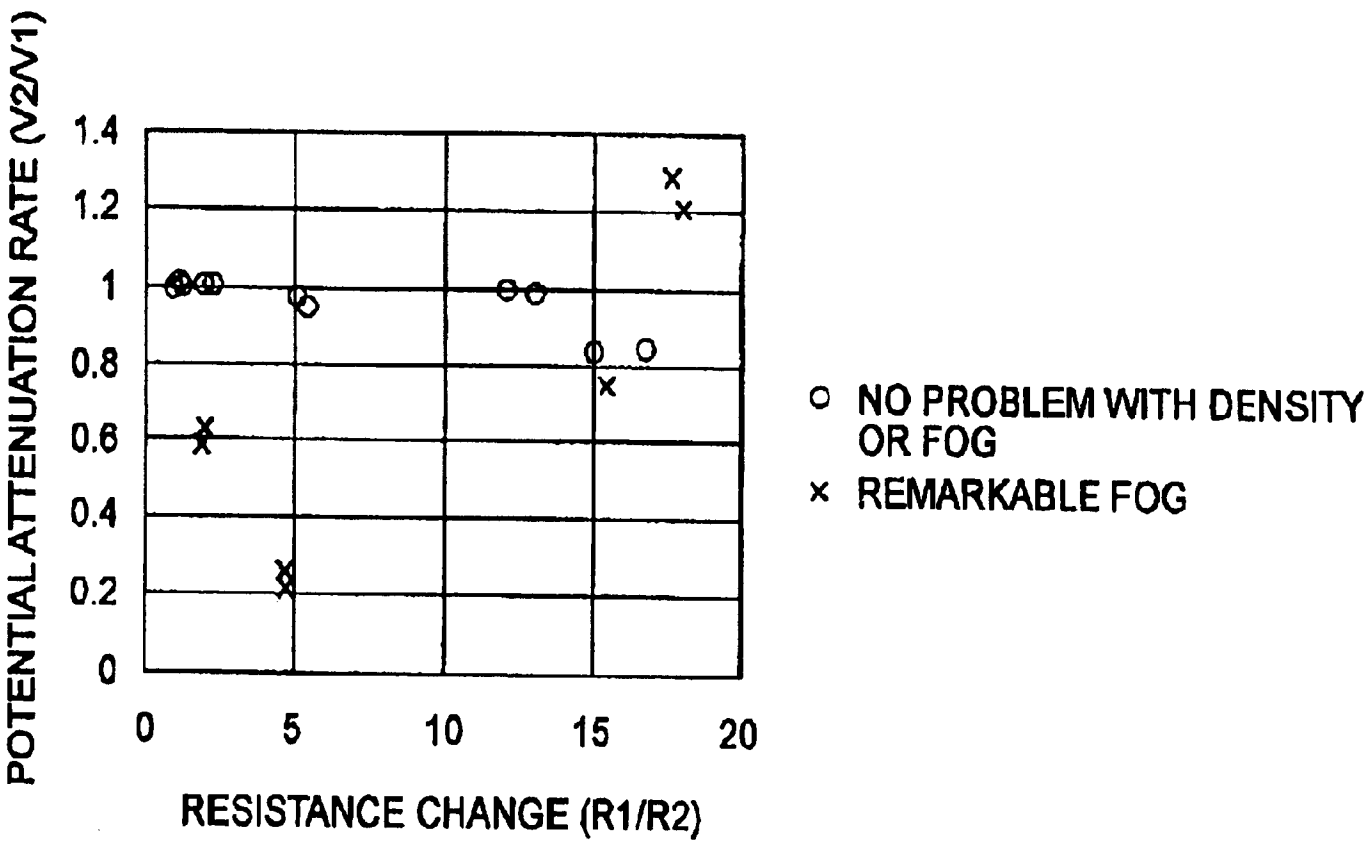
FIG. 11 is a graph showing the effects of the changes in the resistance (R1/R2 and electrical potential attenuation ratio (V2/V1), upon the density irregularity and fog.

FIG. 11 is a graph, similar to FIG. 10, in which the evaluations of nonuniformity in density, and the fog attributable to the current leaks, are plotted, and in which the axes of abscissas and ordinates represent the R1/R2 and potential attenuation factor V2/V1, respectively. It shows the performance evaluations in both Tables 1 and 2, that is, when the VP=50 mm/sec and the performances when Vp=100 mm/sec. In the graph, G means that there was no problem in terms of both the density and fog, and N means that the fog was conspicuous, or the density was too high.

The following are evident from FIG. 11. That is, in order to reduce the possibility of the occurrence of fog, the aforementioned voltages V1 and V2 are desired to be set to satisfy the following inequality:

$$0.8<V2/V1<1.2 \quad (2)$$

The first type of a development roller 5, which can be listed as the one that satisfies the above requirements, is a development roller 5 comprising a metallic core (core member, substrate layer) 5*a* and an electrically conductive elastic layer 5*b*, as a resistive layer, formed on the peripheral surface of the metallic core 5*a*. With the provision of only a single resistive layer, the electrical resistance between the tones supplying member 20 and metallic core 5*a* is smaller than the electrical resistance between the toner supplying member 20 and development station N, and therefore, the current which flows from the toner supplying member 20 to the development roller 5 is less likely to affect the potential in the development station N, making it easier to satisfy the inequality:

$$V2/V1>0.8.$$

It is preferable that the surface of the elastic layer 5*b* is given such a treatment that increases its resistance. As for such a treatment, the surface may be irradiated with ultraviolet rays, exposed to ozone, or chemically treated.

When providing the developments roller 5 with multiple resistive layers, for example, two layers, that is, the elastic layer 5*b* and surface layer 5*c*, it is desired that in order to reduce the influence of the discharge current from the toner supplying member 20 upon the development station N, it is desired that the volumetric resistance of the surface layer (outermost layer) 5*c*, measured while 4 Vp [$\mu$A] of current is flowed, is made to be no less than the volumetric resistance of the elastic layer 5*b*, that is, the inward layer. However, the volumetric resistance of the surface layer 5*c* is desired not to be excessively high, because if it is excessively high, the surface layer 5*c* is highly charged by friction, making it impossible to satisfy the aforementioned inequality:

$$V2/V1<1.2.$$

Thus, it is preferred that the material for the surface layer (outermost layer) 5*c* is such an electrically conductive substance that has an internal mechanism capable of conducting ions, that is, an electrically conductive substances, the electrical resistance of which is less likely to be affected by the applied voltage, because usage of such a substance as the material for the surface layer 5*c* makes it possible to widen the acceptable resistance range for the development roller 5.

The studies intensively made by the inventors of the present invention also revealed the following. The discharge efficiency of the toner supplying member 20 was roughly 50% at most. Thus, the current which flows from the toner supplying member 20 to the development roller 5 needs to be equivalent to a minimum of twice the amount of the charge the toner 7 on the development roller 5 carries. Therefore, the amount of the current which flows from the toner supplying member 20 to the development roller 5 is desired to be no less than 0.08 Vp [$\mu$A]. Further, the development roller 5 is desired to be used under the condition in which the discharge efficiency is low, because it is more stable against the external factors, for example, changes in the ambience, amount of the toner, etc., when used under such a condition. In other words, under such a condition, the development roller 5 can be consistently supplied with a satisfactory amount of the toner 7. Thus, in order to consistently supply the developer roller 5 with a satisfactory amount of the toner 7, this current is desired to be no less than 0.8 Vp [$\mu$A]. On the other hand, this current functions to prevent the problem that the toner becomes welded to the toner supplying member 20 due to the increase in the temperature of the toner supplying member 20. Therefore, in order to prevent this problem, this current is desired to be no more than 100 mA, preferably, no more than 10 mA, for example, when the width of the toner supply member 20 is equivalent to a recording medium of A4 size.

As described above, the employment of the toner supplying member 20 in this embodiment makes it possible to eliminate the toner stripping-supplying roller, which a developing apparatus in accordance with the prior art requires, and is rotationally driven in the developing apparatus, making it thereby possible to reduce the amount of the torque necessary to drive the developing apparatus. In addition, this embodiment of the present invention eliminates the problems that the employment of the toner supplying member 20 might create, that is, the formation of an image suffering from the nonuniformity in density, in the form or streaks, an image suffering from fog, and tie like images.

Embodiment 2

Figure 12:
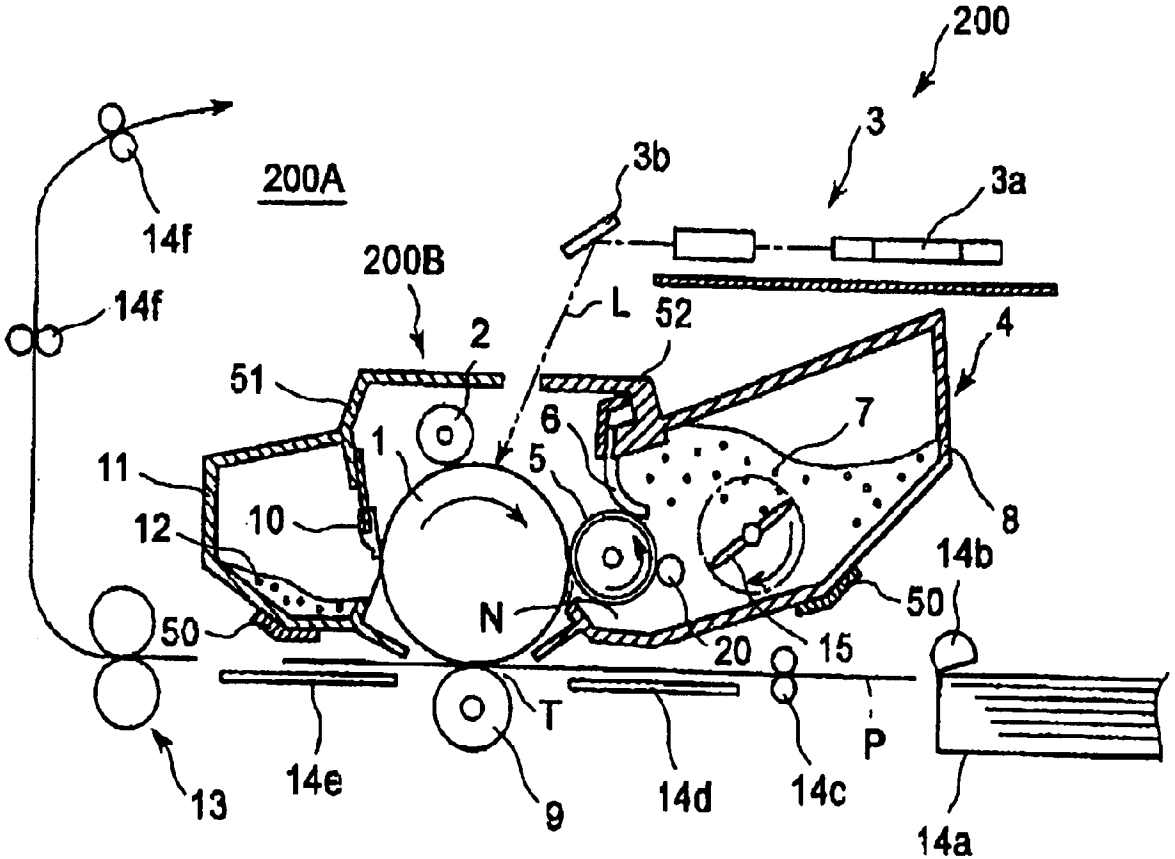
FIG. 12 is a schematic sectional view of the image forming apparatus in the second embodiment of the present invention.

Next, the image forming apparatus in another embodiment of the present invention will be described. FIG. 12 is a schematic sectional view of an image forming apparatus 200 in accordance with the present invention. In terms of the basic structure and operation, the image forming apparatus 200 in this embodiment is the same as that in the preceding embodiment, except that the process cartridge in this embodiment is removably mountable in the main assembly of the image forming apparatus. Thus, the elements of the image forming apparatus in this embodiment which are the same in structure and operation as those in the first embodiment will be given the same referential symbols as those given in the description of the first embodiment, and will not be described here.

Figure 13:
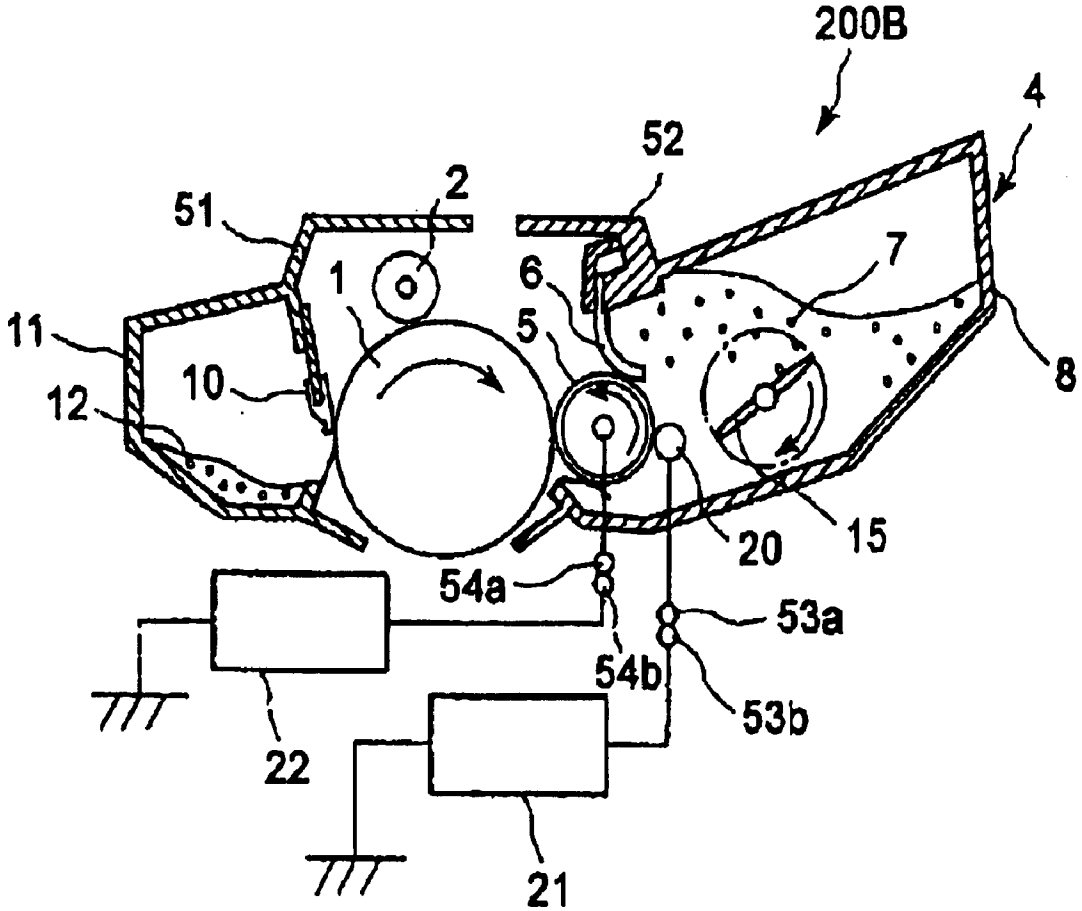
FIG. 13 is a schematic sectional view of the process cartridge in the second embodiment of the present invention.
Figure 14:
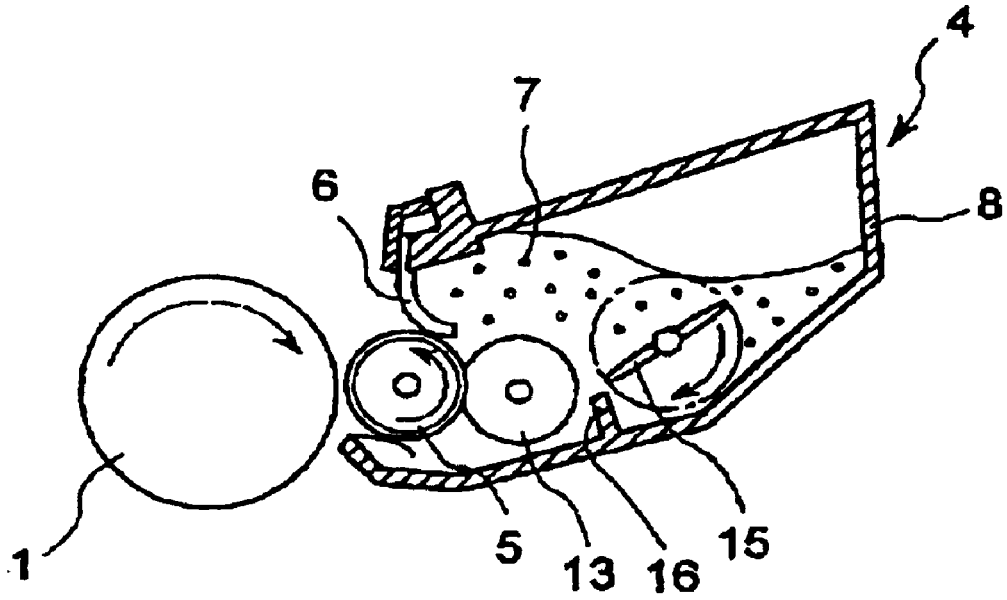
FIG. 14 is a schematic sectional view of a typical developing apparatus in accordance with the prior art.

FIG. 13 is a schematic sectional view of the process cartridge 200B removably mountable in the image forming apparatus 200 in this embodiment. In this embodiment, the process cartridge 200B comprises a cleaning means frame 51 and a developing means frame 52, which are connected to each other. It is removably mountable in the main assembly 200A. Not only does the cleaning means frame 51 function as a waste toner container 11 for storing the waste toner 12, but also serves as a member for supporting the cleaning blade 10, charge roller 2, and photosensitive drum 1. The developing means frame 52 serves as the developer container 8 in which the toner 7 is held, and also, serves as a member for supporting the regulating blade 6, development roller 5, and toner supplying member 20. The developing apparatus 4 (developing means frame 52) of the process cartridge 200B in this embodiment is virtually the same as that in the above described preceding embodiment. The process cartridge 200B is removably mounted into the apparatus main assembly 200A, through the cartridge mounting means 50 of the apparatus main assembly 200A comprising the mounting guides, positioning means, etc.

The cleaning means frame 51 and developing means frame 52 are connected to each other so that a specific positional relationship will be maintained between the two, causing thereby the photosensitive drum 1 and development roller 5 to be pressed against each other so that a predetermined amount of contact pressure is maintained between the two. As the process cartridge 200B is amounted in to the apparatus main assembly 200A, the driving means (unshown) of the apparatus main assembly 200A becomes engaged with the photosensitive drum gear (unshown) for transmitting driving force to the photosensitive drum 1, making it possible to drive the photosensitive drum 1. Also as the process cartridge 200B is mounted into the apparatus main assembly 200A, the photosensitive drum gear meshes with the development roller gear (unshown) for transmitting driving force to the development roller 5, making it possible to drive the development roller 5 with the presence of a predetermined amount of difference in peripheral velocity between the photosensitive drum 1 and development roller 5.

Also as the process cartridge 200B is mounted into the apparatus main assembly 200A, a toner supply bias contact point 53*a* and developer bias contact point 53*a* of the process cartridge 200B for supplying the toner supplying member 20 and development roller 5 with power become connected to the toner supply bias contact point 53*b* and development bias contact point 53*a* of the apparatus main assembly 200A, respectively, making it possible to apply the toner supply bias and development bias to the toner supplying member 20 and development roller 5 of the developing apparatus 4 of the process cartridge 200B from the toner supply bias power source 21 and development bias power source 22 of the apparatus main assembly 200A, respectively.

The employment of this process cartridge system, in which the processing means are integrally disposed in a cartridge so that they can be removably mountable in the main assembly 200A of the image forming apparatus 200, makes it unnecessary for a user to rely on a service person, that is, makes it possible for a user to maintain the apparatus by himself, as the toner 7 is entirely consumed, as the photosensitive drum 1 reaches the end of its service life, as the waste toner container 11 is filled up with the recovered toner 12, or the like occasions. In other words, the employment of this process cartridge system drastically improves the image forming apparatus 200 in operational efficiency Incidentally, the process cartridge in this embodiment comprises: an electrophotographic photosensitive member; processing means (charging means, developing means, and cleaning means) which act on the electrophotographic photosensitive member; and a cartridge in which the electrophotographic photosensitive member and processing means are integrally disposed, and which is removably mountable in the main assembly of the image forming apparatus. The application of the present invention is not limited to a process cartridge configured as described above. For example, the present invention is also applicable to a process cartridge comprising an electrophotographic photosensitive member; a minimum of one processing means among the charging means, developing means, and cleaning means; and a cartridge in which the electrophotographic photosensitive member and processing means are integrally disposed, and which is removably mountable in the main assembly of the image forming apparatus, a process cartridge comprising a minimum of an electrophotographic photosensitive member, and a developing apparatus comprising a developer container for holding developer, a developer carrying member for carrying the developer in the developer container to the object to be developed, and a developer supplying member for better supplying the developer carrying member with the developer; and a cartridge in which the electrophotographic photosensitive drum and developing apparatus are integrally disposed, and which is removably mountable in the main assembly of the image forming apparatus.

The comparison between the process cartridge 200B in this embodiment and a process cartridge comprising the developing apparatus (FIG. 4) in accordance with the prior art, equipped with the developer stripping-supplying roller 13 as a developer supplying member, revealed that the former was roughly 30% smaller in the amount of the torque necessary to drive a process cartridge than the latter. Further, in terms of the size of the developing means frame 52 as the developer container 8 necessary to store a predetermined amount of the developer (toner), the former was smaller by 40 $cm^3$ than the latter.

As will be evident from the above description, this embodiment in which the toner supplying member 20 in accordance with the present invention is employed makes it possible to reduce the amount of the torque necessary to drive the process cartridge 200B, by eliminating the developer stripping-supplying member which a developing apparatus in accordance with the prior art requires, and which must be rotationally driven. Further, the toner supplying member 20 in this embodiment is smaller than the developer stripping-supplying member in accordance with the prior art, making it possible to reduce a process cartridge in size. In other words, this embodiment wakes it possible to reduce a process cartridge in size and in the amount of the torque necessary to drive it.

(Miscellanies)

In the preceding embodiments of the present invention, the core of the toner supplying member 20 is a piece of tungsten wire. However, the material for the core of the toner supplying member 20 does not need to be tungsten wire, as long as it is electrically conductive. Further, the diameter of the toner supplying member 20 has only to be large enough to provide the toner supplying member 20 with a mechanical strength large enough to make the toner supplying member 20 withstand the pressure generated by the friction between the toner supplying a member 20 and toner. For example, if the material is metallic, the diameter of the toner supplying member 20 is desired to be no less than 10 $\mu$m in order to prevent the toner supplying member 20 from breaking under a certain amount of tension.

In the preceding embodiments of the present invention, the developing apparatus 4 is provided with only a single toner supplying member 20. However, the application of the present invention is not limited to a developing apparatus having only a single toner supplying member 20; it is also applicable to a developing apparatus having a plurality of the toner supplying member 20. Providing a developing apparatus with a plurality of the toner supplying member 20 increases the amount by which the development roller 5 is supplied with the toner, making it possible to provide a developing apparatus operable at a higher speed.

Further, the application of the present invention is not limited to a developing apparatus, the developer carrying member (developing member) is an elastic roller as in the preceding embodiments. In other words, the configuration of a developer carrying member is optional, as long as the surface layer of the developer carrying member, which opposes the toner supplying member 20, is not absolutely dielectric, that is, being slightly conductive, and the base layer of the developer carrying member is as conductive as the metallic core of one of the developer carrying members in the preceding embodiments. For example, the developer carrying member may be in the form a tube or belt. Further, the developer carrying member may comprise a metallic cylinder, and a hard surface layer formed of phenol resin or the like, on the peripheral surface of the cylinder.

In the preceding embodiments, the image forming apparatus is provided with only one developing apparatus. However, the present invention is also applicable to an image forming apparatus having a plurality of electrophotographic image forming stations, a plurality of developing apparatuses, and employing a plurality of process cartridges, just as effectively as it is to the image forming apparatuses in the preceding embodiments.

Further, the present invention is applicable to a development cartridge, that is, a developing apparatus in the form of a cartridge removably mountable in the main assembly of an image forming apparatus. In such a case, the development cartridge is removably mounted into the apparatus main assembly through the cartridge mounting means of the apparatus main assembly. In reality, however, a development cartridge may be thought to be the above described process cartridge 200B in the second embodiment minus the cleaning means frame 51.

As described above, the present invention can prevents the level of consistency in the amount by which the developer carrying member of a developing apparatus is supplied with developer, from being reduced by the local current leaks from the developer supplying member to the developer carrying member. Therefore, it can prevent the formation or an image suffering from streaks attributable to the nonuniformity in the amount by which the developer carrying member is provided with the developer. Further, the present invention can prevent the current which flows from the developer supplying member to the developer carrying member, from affecting the development potential. Therefore, it can prevent the formation of an image suffering from such an image defect as fog. Further, the present invention makes it possible to uniformly charge the developer on the peripheral surface of the developer carrying member, by causing electrical discharge with the use of the developer supplying member, in proportion to the discharge efficiency of the developer supplying member. Therefore, it can stabilize the amount by which the developer is supplied to the developer carrying member. Further, the present invention makes it possible to employ a piece of wire, as the developer supplying member, making it thereby possible to provide a developing apparatus smaller in the torque necessary to drive it, simpler in structure, and smaller in size.

While the invention has been described with reference to the structures disclosed herein, it was not confined to the details set forth, and this application was intended to cover such modifications or changes as may come within the purposes of the improvements or the scope of the following claims.

What is claimed is:

1. A developing apparatus comprising:

a developer carrying member, for carrying a developer to a developing portion, said developer carrying member including an electroconductive base and a resistance layer provided thereon;

a developer feeding member for being supplied with a voltage to supply the developer to said developer carrying member;

wherein a surface moving speed of said developer carrying member Vp [mm/sec], a resistance R1 (Ω) of said developer carrying member when an electric current applied said developer carrying member is 0.04 Vp [μA], and a resistance R2 (Ω) of said developer carrying member when the electric current applied to said developer carrying member is 4 Vp [μA], satisfy:

$$R1/R2<15.$$

2. An apparatus according to claim 1, wherein the resistance R1 satisfies $R1<10^8\Omega$, and the resistance R2 satisfies $10^5\Omega \leqq R2$.

3. An apparatus according to claim 1, wherein R1/R2<5 is satisfied.

4. An apparatus according to claim 1 or 2, wherein the voltage is not less than a discharge starting voltage at which electric discharge starts between said developer carrying member and said developer feeding member.

5. An apparatus according to claim 1 or 2, wherein when an electric current applied to said base is 4 Vp [μA ], a potential V1 (V) of said base and a surface potential V2 (V) of said developer carrying member at said developing portion, satisfy:

$$0.8<V2/V1<1.2.$$

6. An apparatus according to claim 1 or 2, wherein said developer feeding member is supplied with the voltage such that not less than 0.08 Vp [μA] current of the same charge polarity as the developer flows from said developer feeding member to said developer carrying member.

7. An apparatus according to claim 1, wherein said developer feeding member is in the form of electroconductive wire.

8. An apparatus according to claim 7, wherein said electroconductive wire is not rotatable.

9. An apparatus according to claim 1, wherein a portion around a periphery of said developer feeding member is filled with the developer at least when said developer feeding member is driven.

10. An apparatus according to claim 1, wherein said developing apparatus is detachably mountable to a main assembly of an image forming apparatus.

11. An apparatus according to claim 1, wherein said developing device is detachably mountable to a main assembly of an image forming apparatus together with an image bearing member for which said developing device is operable for development.

12. A developing apparatus comprising:

a developer carrying member, for carrying a developer to a developing portion, said developer carrying member including an electroconductive base and a resistance layer provided thereon;

a developer feeding member for being supplied with a voltage to supply the developer to said developer carrying member;

wherein a surface moving speed Vp [mm/sec] of said developer carrying member, a potential V1 (V) of said base layer when an electric current applied to said base is 4 Vp [μA], and a surface potential V2 of said developer carrying member at said developing portion, satisfy $$0.8<V2/V1<1.2.$$

13. An apparatus according to claim 12, wherein the voltage is not less than a discharge starting voltage at which electric discharge starts between said developer carrying member and said developer feeding member.

14. An apparatus according to claim 12, wherein said developer feeding member is supplied with the voltage such that not less than 0.08 Vp [μA] current of the same charge polarity as the developer flows from said developer feeding member to said developer carrying member.

15. An apparatus according to claim 12, wherein said developer feeding member is in the form of electroconductive wire.

16. An apparatus according to claim 15, wherein said electroconductive wire is not rotatable.

17. An apparatus according to claim 12, wherein a portion around periphery of said developer feeding member is filled with the developer at least when said developer feeding member is driven.

18. An apparatus according to claim 12, wherein said developing apparatus is detachably mountable to a main assembly of an image forming apparatus.

* * * * *

UNITED STATES PATENT AND TRADEMARK OFFICE

CERTIFICATE OF CORRECTION

PATENT NO. : 6,965,743 B2
DATED : November 15, 2005
INVENTOR(S) : Ken Nakagawa et al.

It is certified that error appears in the above-identified patent and that said Letters Patent is hereby corrected as shown below:

Title page,
Item [30], Foreign Application Priority Data, "2003/027638" should read -- 2003-027638 --.
Item [57], ABSTRACT,
Line 11, "or" should read -- of --.
Line 14, "r1/R2<15." should read -- R1/R2<15. --.

Column 2,
Line 50, "bend," should read -- bent, --.

Column 3,
Line 25, "document," should read -- documents, --.

Column 4,
Line 43, "sate" should read -- state --.
Line 50, "sore" should read -- more --.

Column 5,
Line 21, "(R1/R2" should read -- (R1/R2) --.
Line 32, "EMBODIMENT" should read -- EMBODIMENTS --.

Column 6,
Line 1, "(unshown)" should read -- (unshown). --.
Line 27, "or" should read -- of --.

Column 7,
Line 29, "weans" should read -- means --, and "assembly100A" should read -- assembly 100A --.
Line 43, "an" should read -- a --.

Column 9,
Line 27, "she" should read -- the --.

Column 10,
Line 30, "of" (second occurrence) should be deleted.

Column 11,
Line 27, "vacuum," should read -- vacuum --.

UNITED STATES PATENT AND TRADEMARK OFFICE

CERTIFICATE OF CORRECTION

PATENT NO. : 6,965,743 B2
DATED : November 15, 2005
INVENTOR(S) : Ken Nakagawa et al.

It is certified that error appears in the above-identified patent and that said Letters Patent is hereby corrected as shown below:

Column 13,
Line 2, “mount” should read -- amount --.
Line 4, “to” (first occurrence) should be deleted.
Line 40, “increase.” should read -- increases. --.

Column 15,
Line 49, “it” should read -- its --.
Line 59, “Ltd.,)” should read -- Ltd.), --.
Line 64, “LR800:” should read -- LR8000: --.

Column 16,
Line 26, “elections” should read -- electrons --.
Line 35, “virtually entirety” should read -- virtually the entirety --.
Line 42, “she” should read -- the --.

Column 17,
Lines 9 and 39, “or” should read -- of --.

Column 18,
Line 6, “or” should read -- of --.

Column 19,
Line 35, “ions” should read -- ion --.

Column 20,
Line 8, “ate” should read -- the --.

Column 22,
Line 1, “8 am” should read -- 8 mm --.

Column 25,
Line 6, “conductivity” should read -- conductivity. --.
Line 37, “a” should be deleted.

Column 26,
Line 27, “or” should read -- of --.

Column 27,
Line 39, “substances.” should read -- substance, --.

UNITED STATES PATENT AND TRADEMARK OFFICE

CERTIFICATE OF CORRECTION

PATENT NO. : 6,965,743 B2
DATED : November 15, 2005
INVENTOR(S) : Ken Nakagawa et al.

It is certified that error appears in the above-identified patent and that said Letters Patent is hereby corrected as shown below:

Column 28,
Line 15, “or” should read -- of --.
Line 16, “tie” should read -- the --.
Line 59, “amounted” should read -- mounted --.

Column 30,
Line 14, “wakes” should read -- makes --.

Column 31,
Line 9, “prevents” should read -- prevent --.
Line 51, “applied said” should read -- applied to said --.
Line 67, “4 $V_p$ [μA ],” should read -- 4 $V_p$ [μA], --.

Column 32,
Line 41, “satisfy” should read -- satisfy: --.

Signed and Sealed this

Thirtieth Day of May, 2006

JON W. DUDAS
*Director of the United States Patent and Trademark Office*